US007182611B2

(12) United States Patent
Borden et al.

(10) Patent No.: US 7,182,611 B2
(45) Date of Patent: Feb. 27, 2007

(54) DUAL-SECTIONED GROUNDING BUSHING ASSEMBLY

(76) Inventors: Aaron M. Borden, 835 Gametrail - Apt #102, Lakemoor, IL (US) 60051; Tomas J. Zanzola, 4803 Barreville Rd., Prairie Grove, IL (US) 60012

( * ) Notice: Subject to any disclaimer, the term of this patent is extended or adjusted under 35 U.S.C. 154(b) by 235 days.

(21) Appl. No.: 11/029,721

(22) Filed: Jan. 5, 2005

(65) Prior Publication Data

US 2005/0188501 A1 Sep. 1, 2005

Related U.S. Application Data

(63) Continuation-in-part of application No. 10/789,752, filed on Feb. 26, 2004, now Pat. No. 6,840,782.

(51) Int. Cl.
*H01R 13/648* (2006.01)

(52) U.S. Cl. ..... 439/92

(58) Field of Classification Search ..... 439/92, 439/100, 799, 777, 83, 98, 833
See application file for complete search history.

(56) References Cited

U.S. PATENT DOCUMENTS

| | | | | |
|---|---|---|---|---|
| 1,486,560 | A | 3/1924 | Becker | |
| 1,690,220 | A | 11/1928 | Fahestock | |
| 3,385,618 | A | 5/1968 | Hargis | |
| 3,456,965 | A | 7/1969 | Gajewski et al. | |
| 3,967,872 | A | 7/1976 | Mooney et al. | |
| 3,985,411 | A | 10/1976 | Mooney et al. | |
| 4,002,396 | A | 1/1977 | Murdock | |
| 4,189,198 | A | 2/1980 | Reichman | |
| 4,233,469 | A | 11/1980 | Steppe | |
| 4,248,490 | A * | 2/1981 | Bachle | 439/98 |
| 4,257,658 | A * | 3/1981 | Hammond et al. | 439/98 |
| 4,806,108 | A | 2/1989 | Meinhardt | |
| 4,855,533 | A | 8/1989 | Meyer Swantee | |
| 5,170,885 | A | 12/1992 | Guenther et al. | |
| 5,314,343 | A | 5/1994 | Englander | |
| 5,616,036 | A | 4/1997 | Polidori | |
| 5,767,449 | A * | 6/1998 | Gronowicz, Jr. | 174/78 |
| 5,911,585 | A | 6/1999 | Zwit | |
| 5,929,383 | A * | 7/1999 | Marik et al. | 174/78 |
| 6,241,563 | B1 * | 6/2001 | Warner et al. | 439/789 |
| 6,376,772 | B1 | 4/2002 | Pioch | |

* cited by examiner

*Primary Examiner*—Tulsidas C. Patel
*Assistant Examiner*—Phuongchi Nguyen
(74) *Attorney, Agent, or Firm*—Meroni + Meroni, P.C.; Charles F. Meroni, Jr.; Christopher J. Scott

(57) ABSTRACT

The present invention provides a grounding bushing assembly essentially comprising a first bushing section, a second bushing section, select pivot structure, select latch structure, and select ground conductor attachment structure. The first bushing section, second bushing section, select pivot structure, select latch structure, and select ground conductor attachment structure are all preferably constructed from electrically conductive materials for allowing electric charges to migrate through the material. The first and second sections each comprise an arc length intermediate the section ends, which are lengths together function to cooperatively form an annular, dual-sectioned, grounding bushing. The resulting grounding bushing comprises an inner annular surface, an outer annular surface, a conductor inlet end, a conductor outlet end, and unique ground conductor attachment structure. The present invention enables an installer thereof to install the same in cooperative association with a ground conductor either before or after electrical connections are finalized.

48 Claims, 12 Drawing Sheets

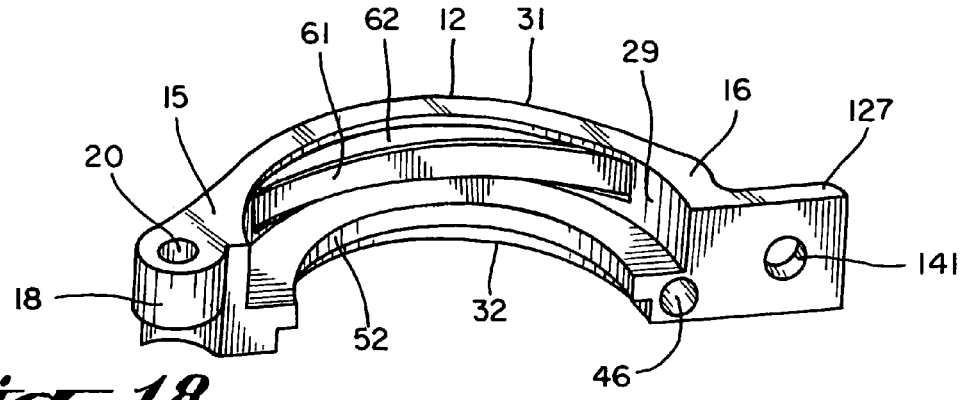
Fig. 18
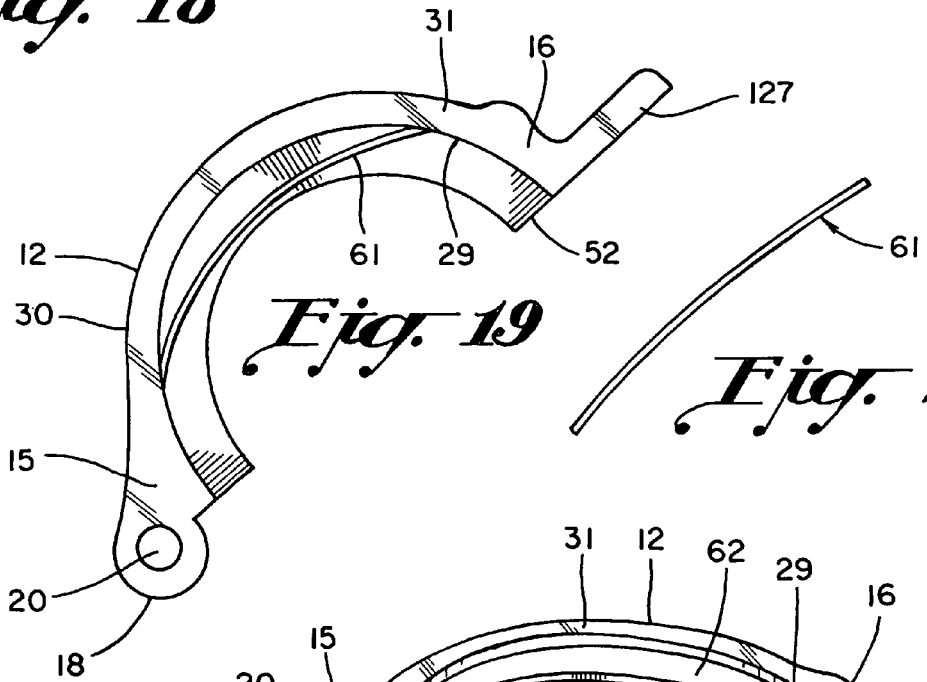
Fig. 19
Fig. 20
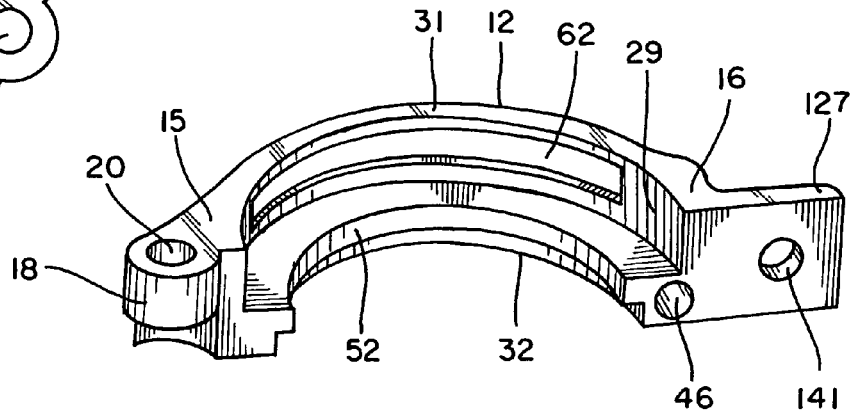
Fig. 21

DUAL-SECTIONED GROUNDING BUSHING ASSEMBLY

PRIOR HISTORY

This application is a continuation-in-part patent application claiming priority to U.S. patent application Ser. No. 10/789,752, filed in the United States Patent and Trademark Office on Feb. 26, 2004 now U.S. Pat. No. 6,840,782.

BACKGROUND OF THE INVENTION

1. Field of the Invention

The present invention generally relates to an improved bushing assembly for use in combination with electrical conduit. More particularly, the present invention relates to a bifurcated or dual-sectioned grounding bushing assembly, which grounding bushing assembly effectively allows electricians to install the grounding bushing assembly either before or after completing wiring connections at a junction box.

2. Description of the Prior Art

Bushings are typically installed on the terminal end of electrical conduit at an electrical junction box to serve as an aperture lining through which electrical conductors pass. Bushings are often required so as to reduce the likelihood that the electrical conducting materials will improperly contact either the junction box or conduit terminus. In other words, without a properly installed bushing in place, the electrical conductors may become damaged, leading to unsafe conditions. Grounding bushings have the additional function of providing the circuitry with a path to a zero potential with respect to the Earth.

As noted in U.S. Pat. No. 4,233,469 ('469 Patent), wiring connections are, on occasion, mistakenly finalized before the bushing or grounding bushing is installed. Improper electrical installations such as those here identified must be remedied for safety reasons and thus on the occasion when a traditional, unibody, annular bushing member is omitted from an installation site, electricians must (1) disconnect the wiring, (2) feed the electrical conductors through the unibody bushing member, (3) properly reinstall the bushing member, and (4) reconnect the wiring. The described methodological error significantly increases the labor involved at a given job site, thus increasing costs to contractors and consumers alike. Methodological errors such as those here identified are difficult to completely eradicate given the occasional human error. The ramifications from these types of errors may be easily minimized, if a hinged bushing is utilized (See generally, for example, the '469 Patent). The prior art also teaches a variety of devices to effect enhanced electrical grounds. Some of the more pertinent prior art relating to these subjects is described hereinafter.

U.S. Pat. No. 1,690,220 ('220 Patent), which issued to Fahnestock, discloses a Ground Connector. The '220 Patent teaches in relevant portion, a spike cooperatively associated with the internal surface of a ground connector. The spike is designed for piercing through surface materials located on conductive piping so as to make proper electrical contact between the ground connector and the piping. Further, the two ends of the ground connector comprise first and second screw—receiving portions for cooperatively receiving a tightening screw. When the tightening screw is removably inserted into the first and second screw—receiving portions for tightening the hinged grounding bushing in circumferential relationship to at least one current carrying wire, the spike makes proper electrical contact with the conductive piping.

U.S. Pat. No. 3,985,411 ('411 Patent), which issued to Mooney et al., discloses a Hinged Ground Clamp. The '411 Patent teaches an electrical conduit grounding assembly comprising a grounding cable and a pair of clamp members. Each clamp member is constructed from conductive material and comprises a hinge portion, a tightening portion, and an inner clamp surface. Each inner clamp surface comprises a teeth or ribs for making electrical contact with a conductive conduit. The hinge portions cooperatively form a hinge knuckle through which the grounding cable passes. A screw engages a tapped bore in each of the tightening portions to permit their tightening.

U.S. Pat. No. 4,189,198 ('198 Patent), which issued to Reichman, discloses a Conduit Ground Wire Coupling. The '198 Patent teaches a conduit coupling collar constructed of conductive materials having a threaded inside surface. Integrally formed with coupling collar is an axially inwardly inclined annular flange. A non-conductive bushing member is entrapped in the space delineated by the annular flange. A set screw or bolt is removably insertable through any of a plurality of tapped bores and fastens a clamp member to the coupling collar. The set screw makes electrically conductive contact with the threaded inside surface.

U.S. Pat. No. 4,223,469 ('469 Patent), which issued to Steppe, discloses a Conduit Bushing. The '469 Patent teaches a conduit bushing constructed from insulative materials comprising first and second bushing halves, hinge means, and latch means. Each bushing half comprises a latch portion and a hinge portion. The hinge means hingedly connect the first and second bushing halves at the hinge portions, and the latch means removably fasten the latch portions together.

U.S. Pat. No. 4,806,108 ('108 Patent), which issued to Meinhardt, discloses a Grounding Bushing. The '108 Patent teaches a grounding bushing constructed from conductive materials and thus permits grounding. The grounding bushing comprises an annular band, a threaded inner surface, and a plurality of raised bosses. Each boss comprises a set screw—receiving bore. A set screw is utilized to fasten a ground wire—receiving lug to the grounding bushing. When in a fastened state, the set screw makes electrically conductive contact between the lug, the bushing and a conductive conduit.

It will thus be noted that while the '469 Patent does teach a hinged bushing, which bushing enables an installer to install the device either before or after electrical connections are finalized, the '469 Patent does not teach a hinged grounding bushing. Grounding bushings, as opposed to insulative bushings, must communicate electrically with the terminal end of an electrical conduit adjacent an electrical junction box. That is, the grounding bushing must be constructed, at least in part, from electrically conductive materials, thus being able to serve as a bridge for migrating charges as they move to zero potential. The '469 Patent does not address the structural peculiarities inherent in essential grounding bushing art. Further, while the '411 Patent does disclose a hinged ground clamp, it does not teach a hinged grounding bushing. From a review of the above-referenced patents and other prior art generally known to exist, it will be seen that the prior art does not teach a dual-sectioned grounding bushing for enabling installers to install the bushing either before or after electrical connections are finalized at a junction box.

SUMMARY OF THE INVENTION

Accordingly, it is an object of the present invention to provide a dual-sectioned grounding bushing assembly, which assembly allows installers thereof to install the assembly either before or after electrical connections are finalized. In this regard, it is a further object of the present invention to provide a grounding bushing assembly comprising first and second bushing sections pivotable about a select pivot point, and removably fastenable at a select latch point. Thus, it is an object of the present invention to overcome the inherent shortcomings of traditional unibody, annular grounding bushings in which it is impossible to radially direct or translate finally connected electrical conductors or other matter from regions exterior to the outer annular surface of an annular grounding bushing to regions radially interior to the inner annular surface without disconnecting the electrical connections.

Further, it is an object of the present invention to provide a plurality of select latch means, a plurality of select hinge means, a plurality of select inner annular conductive contact means, a plurality of select conductor outlet bushing means, and a plurality of select ground conductor attachment means. Thus, it is a further object of the present invention to provide a plurality of select latch means wherein the select latch means are chosen from the group consisting of axially-orthogonal latch means and select axially-parallel latch means. The select axially-parallel latch means may be selected from the group consisting of ball-plunger knuckle latch means and latch-pin knuckle latch means.

Further, it is an object of the present invention to provide a plurality of select pivot means or select hinge means. In this regard, it is an object of the present invention to provide select pivot means or hinge means that may be selected from the group consisting of insertable-pin hinge means, fixed-post hinge means, and triaxial pivot means.

To achieve these and other readily apparent objectives, the present invention provides a grounding bushing assembly essentially comprising a first bushing section, a second bushing section, select hinge means, and select latch means. The first bushing section essentially comprises a first section hinge end, a first section latch end, and a first section arc length intermediate the first section hinge end and the first section latch end. The second bushing section essentially comprises a second section hinge end, a second section latch end, and a second section arc length intermediate the second section hinge end and the second section latch end.

The select pivot means or select hinge means function to movably connect the first bushing section to the second bushing section and may be summarized, in turn, by the following language. The insertable-pin hinge means may be defined by first section hinge knuckle structure, second section hinge knuckle structure, and a hinge pin. The first section hinge knuckle structure is integrally formed with the first bushing section adjacent the first section hinge end and the second section hinge knuckle structure is integrally formed with the second bushing section adjacent the second section hinge end. The first and second section hinge knuckle structures each comprise hinge pin-receiving structure, which structure has a hinge pin axis. The hinge pin is insertable into the hinge pin-receiving structure for pivotally connecting the first bushing section to the second bushing section.

The fixed-post hinge means may be defined by first section hinge knuckle structure, second section hinge knuckle structure, and a fixed hinge post. The first section hinge knuckle structure is integrally formed with the first bushing section adjacent the first section hinge end. The second section hinge knuckle structure is integrally formed with the second bushing section adjacent the second section hinge end. The hinge post is integrally formed with the second section hinge knuckle structure and has a hinge post axis. The first section hinge knuckle structure comprises hinge post-receiving structure, which is cooperatively associated with the hinge post for pivotally connecting the first bushing section to the second bushing section.

The triaxial pivot means may be defined by first section pivot structure and second section pivot structure. The first section pivot structure is integrally formed with the first bushing section adjacent the first section pivot end and the second section pivot structure is integrally formed with the second bushing section adjacent the second section pivot end. The first and second section pivot structures are cooperatively associated with one another for movably connecting the first bushing section to the second bushing section. The triaxial pivot means thus allow triaxial movement between the first bushing section and the second bushing section.

The select latch means function to removably fasten the first section latch end to the second section latch end such that the first and second section arc lengths cooperatively form an annular, dual-sectioned grounding bushing, the grounding bushing comprising an inner annular surface, an outer annular surface, a conductor inlet end, a conductor outlet end, and a bushing axis. The select latch means may be summarized, in turn, by the following language.

The axially-orthogonal latch means may be defined by first section latch structure, second section latch structure, and a latch pin. The first section latch structure is integrally formed with the first bushing section adjacent the first section latch end and the second section latch structure is integrally formed with the second bushing section adjacent the second section latch end. The first and second latch structures each comprise latch pin-receiving structure, which latch pin-receiving structure has a latch pin axis. The latch pin is removably insertable into the latch pin-receiving structure for removably fastening the first section latch end to the second section latch end. The latch pin axis is thus substantially orthogonal (whether spaced or intersecting) to the bushing axis.

The ball-plunger knuckle latch means may be defined by first section latch knuckle structure, second section knuckle structure, an inlet end ball plunger and an outlet end ball plunger. The first section latch knuckle structure comprises an inlet end knuckle and an outlet end knuckle. The inlet end knuckle is in axially spaced relation to the outlet end knuckle. The inlet end knuckle and the outlet end knuckle thus define a knuckle-receiving gap. The inlet end and outlet end ball plungers each comprise a ball end, a head end, and spring means for ball end displacement. The inlet end and outlet end ball plungers are insertable in the latch pin-receiving structure such that the ball ends extend into the knuckle-receiving gap. The second section latch knuckle structure comprises an inlet end surface and an outlet end surface. The inlet end and the outlet end surfaces each comprise axially-aligned ball-receiving dimples. The second section latch knuckle structure is receivable in the knuckle-receiving gap. The spring means allow the ball ends to be oppositely displaced and seatable in the ball-receiving dimples for removably fastening the first section latch end to the second section latch end. Notably, the latch pin axis is substantially parallel to the bushing axis.

The latch-pin knuckle latch means may be defined by first section latch knuckle structure, second section latch knuckle structure, and a latch pin. The first section latch knuckle structure is integrally formed with the first bushing section adjacent the first section latch end and the second section latch knuckle structure is integrally formed with the second bushing section adjacent the second section latch end. The first and second latch knuckle structures each comprise latch pin-receiving structure, which structure has a latch pin axis. The latch pin is insertable into the latch pin-receiving structure for removably fastening the first section latch end to the second section latch end. The latch pin axis is substantially parallel to the bushing axis.

It is thus contemplated that the latch pin axis may have a select latch axis orientation, the select latch axis orientation being selected from the group consisting of a hinge post (or pin) parallel orientation and a hinge post (or pin) orthogonal orientation. The hinge post parallel orientation is defined by the latch pin axis being substantially parallel to the hinge post (or pin) axis and the hinge post orthogonal orientation is defined by the latch pin axis being substantially orthogonal to the hinge post (or pin) axis.

The present invention further contemplates that the grounding bushing may comprise select bushing means, the select bushing means being cooperatively associated with the grounding bushing assembly for protecting electrical conductor(s) passing therethrough. The select bushing means are thus spatially located intermediate the conductor inlet end and the conductor outlet end adjacent the inner annular surface. The select bushing means may be selected from the group consisting of an annular flange, a dual-sectioned bushing member, and an annular beveled surface.

Further, the present invention contemplates that the inner annular surface may comprise select conductive contact means or structure. The select conductive contact structure is designed to enhance or increase electrical communication with the conduit terminus. The select conductive contact structure may be selected from the group consisting of a conductive contact ridge, at least one conductive contact spike, a conductive contact spring member, and select compression ring structure. The select compression ring structure may be selected from the group consisting of a gapped compression ring and a dual-sectioned compression ring.

The conductor inlet end is designed for attachment to a conduit terminus and to receive at least one electrical conductor, which electrical conductor exits the conduit terminus. The electrical conductor or conductors are typically fed through conduit terminus so as to be finally and electrically connected to electrical connection points or other similar structure adjacent the conduit terminus. The present invention is thus specified to enable an installer to install the assembly either before or after electrical connections are finalized by (1) either feeding unconnected electrical conductors through the grounding bushing assembly when in an annular configuration (before electrical connections are finalized) or by (2) feeding an open pivoted grounding bushing assembly around connected electrical conductors (after electrical connections are finalized) and pivoting closed the open grounding bushing assembly to an annular configuration for attachment to the conduit terminus.

In sum, the grounding bushing assembly essentially comprises a first bushing section, a second bushing section, select pivot means or select hinge means, and select latch means. The first bushing section, second bushing section, select pivot or hinge means, and select latch means are all preferably constructed from electrically conductive materials and are thus electrically communicative with one another, allowing electric charges to migrate through the material.

The present invention further contemplates that the grounding bushing assembly comprises ground conductor attachment means which further function to allow electric charges to migrate from the grounding bushing assembly to a ground conductor. The ground conductor provides a path to ground or the Earth. In this last regard, the ground conductor attachment means may be summarized by a ground conductor-receiving tunnel, set screw-receiving structure, and at least one set screw. The ground conductor-receiving tunnel is essentially formed through the grounding bushing adjacent the select latch means. The ground conductor-receiving tunnel preferably has a select tunnel axis, which is selectively chosen to vary with respect to the bushing axis. The ground conductor-receiving tunnel is designed to receive a ground conductor. The set screw-receiving structure orthogonally intersects the ground conductor-receiving tunnel. At least one set screw may then be removably inserted in the set screw-receiving structure for removably attaching a ground conductor to the given grounding bushing.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of our patent drawings, as follows:

FIG. 11(*b*) is a perspective view of a first bushing section of the fourth alternative embodiment of the grounding bushing assembly as viewed from a conductor outlet end.

FIG. 15(*b*) is a perspective view of a dual-sectioned compression ring for use in combination with the sixth alternative embodiment of the grounding bushing assembly.

FIG. 17(*b*) is a perspective view of a first bushing section of the seventh alternative embodiment of the grounding bushing assembly as viewed from a conductor outlet end.

FIG. 18 is a perspective view of a second bushing section of an eighth alternative embodiment of the grounding bushing assembly showing a spring member cooperatively associated with the inner annular surface as viewed from a conductor inlet end.

FIG. 19 is a plan view of the second bushing section of FIG. 19 as viewed from the conductor inlet end.

FIG. 20 is a side view of the spring member as illustrated in FIGS. 18 and 19.

FIG. 21 is a perspective view of the second bushing section of the eighth alternative embodiment of the grounding bushing assembly showing the spring member removed from cooperative association with the inner annular surface as viewed from the conductor inlet end.

DETAILED DESCRIPTION OF THE PREFERRED EMBODIMENT

Figure 1:
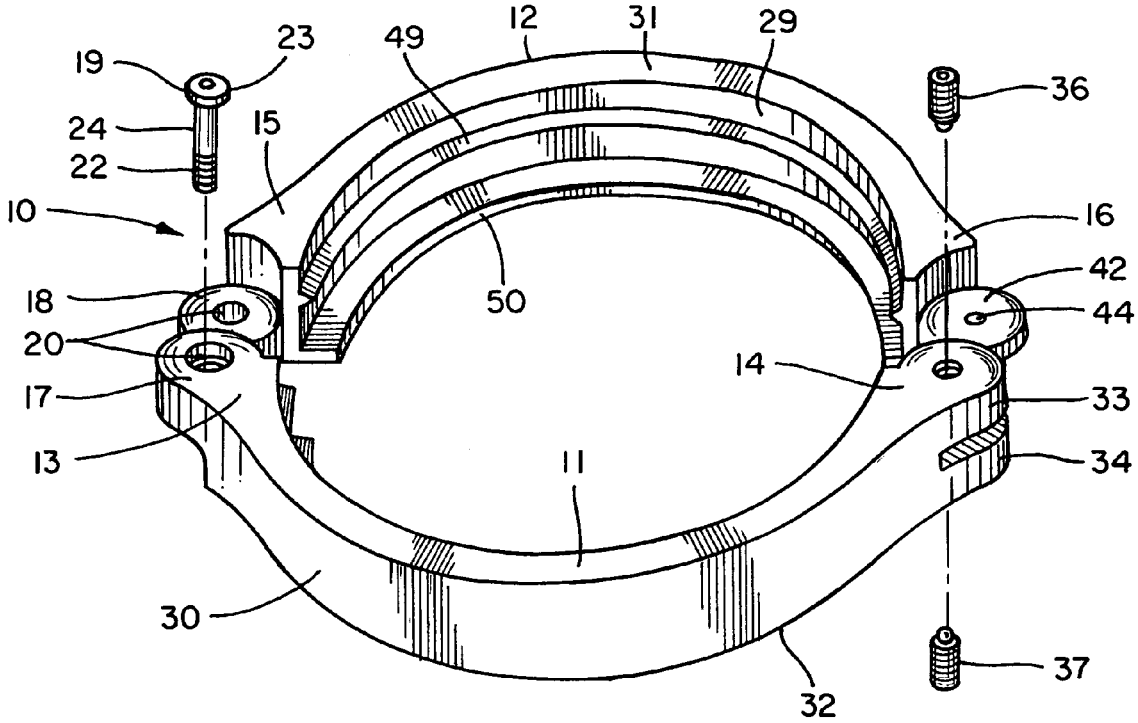
FIG. 1 is a perspective view of the preferred embodiment of the grounding bushing assembly in an unassembled state as viewed from a conductor inlet end.
Figure 2:
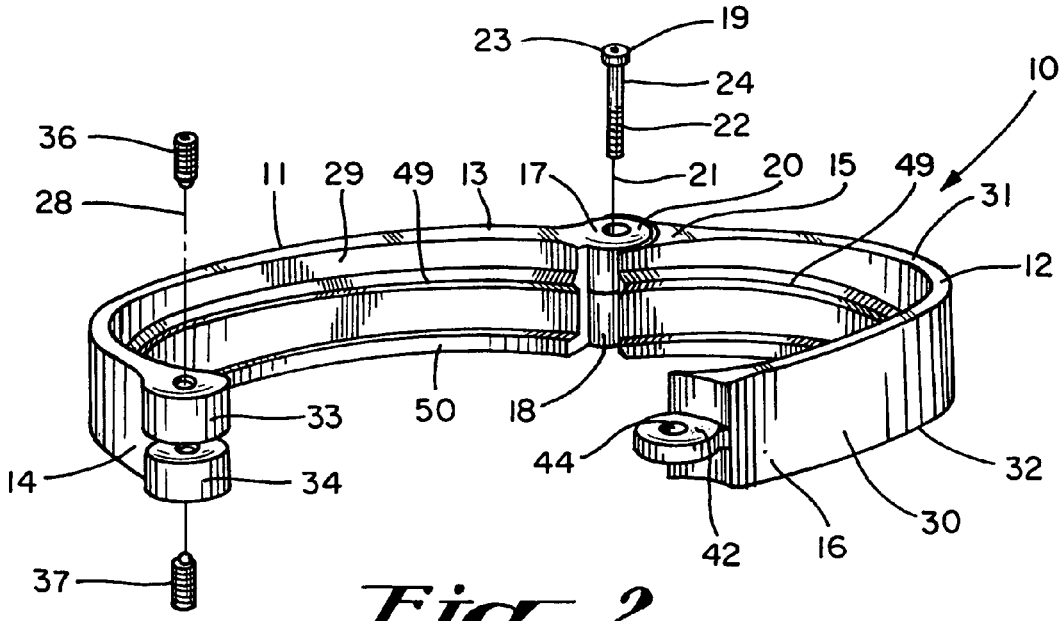
FIG. 2 is a perspective view of the preferred embodiment of the grounding bushing assembly in a partially assembled stated as viewed from a conductor inlet end.
Figure 6:
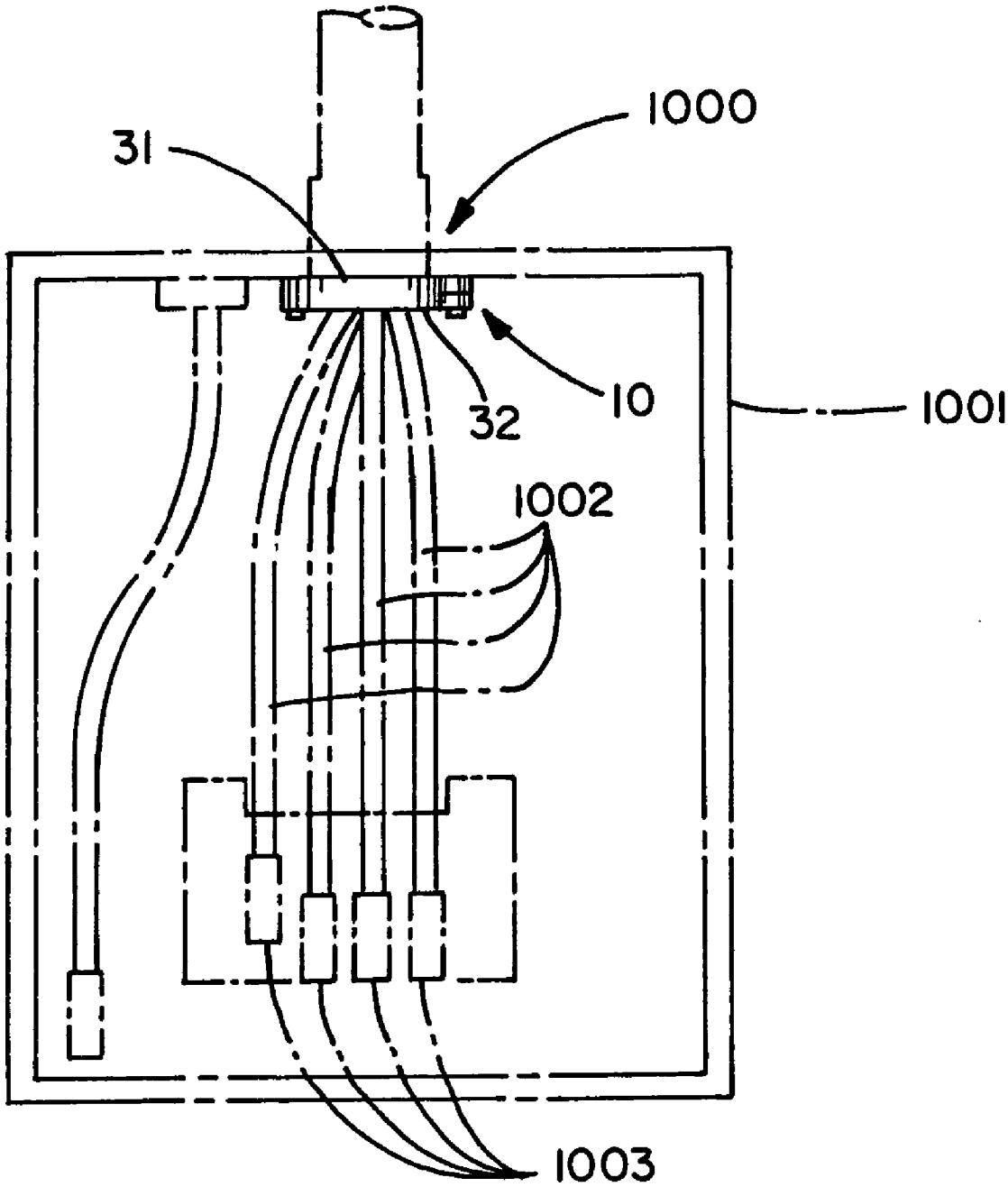
FIG. 6 is a plan view of an installed bushing assembly at a phantom junction box showing finally connected phantom electrical conductors and a phantom conduit terminus.

Referring now to the drawings, the preferred embodiment of the present invention concerns a dual-sectioned, grounding bushing assembly 10 as generally referenced in FIGS. 1, 2, and 6. Grounding bushing assembly 10 essentially functions to allow an electrician or other installer of grounding bushings to install grounding bushing assembly 10 either before or after electrical connections are finalized at an electrical junction box. Referencing FIG. 6, the reader will see that grounding bushing assembly 10 is installed on a conduit terminus 1000 at an electrical junction box 1001. Typically, a plurality of electrical conductors 1002 exit conduit terminus 1000 and are fixedly attached to connection points 1003 in electrical junction box 1001 so as to finalize the electrical connections at a given site. It will be recalled that bushings are typically installed on the terminal end of electrical conduit or at conduit terminus 1000 at electrical junction box 1001 to serve as an aperture lining through which electrical conductors 1002 pass. Bushings are often required so as to reduce the likelihood that the electrical conducting materials or electrical conductors 1002 will improperly contact either the electrical junction box 1001 or conduit terminus 1000. In other words, without a properly installed bushing in place, electrical conductors 1002 may become damaged, leading to unsafe conditions. Notably, grounding bushings have the additional key function of providing the electric circuitry with a path to a zero potential with respect to the Earth. The Earth may then be considered an infinite "sink" to which electric charges can easily migrate.

As has been noted, wiring connections are, on occasion, mistakenly finalized before the traditional unibody bushing or traditional unibody, annular, grounding bushing is installed. It will be understood from an inspection of FIG. 6 that if an electrician or other installer were to finalize electrical connections at connection points 1003 without installing a traditional, unibody, annular grounding bushing or similar other unibody bushing at the conduit terminus 1000, the electrician or installer would be required to (1) disconnect the electrical conductors 1002 from connection points 1003, (2) feed the electrical conductors 1002 through the unibody bushing member, (3) properly reinstall the unibody bushing member, and (4) reconnect the electrical conductors 1002 to connection points 1003.

As earlier noted, the described methodological error significantly increases the labor involved at a given job site, thus increasing costs to contractors and consumers alike. Methodological errors such as those here identified are difficult to completely eradicate given the occasional human error. The costly ramifications of these types of errors may be easily minimized, however, if a dual-sectioned bushing is utilized. The benefits of the present invention will thus will be readily understood from a consideration of the following specifications.

Grounding bushing assembly 10 preferably comprises a first bushing section 11 as generally illustrated and referenced in FIGS. 1, 2, 7–10, 11(*b*), 12–14, 16, 17(*b*), 22, 23, and 25; and a second bushing section 12 as generally illustrated and referenced in FIGS. 1, 2, 7–11*a*, 12–14, 16, 17(*a*), 18, 19, 21, and 22. Grounding bushing 10 further preferably comprises hinge means and latch means, described in more detail below. First bushing section 11 preferably comprises a first section hinge end 13 as illustrated and referenced in FIGS. 1, 2, 8–10, 11(*b*)–14, 16, 17(*b*), 22, 23, and 25; a first section latch end 14 as illustrated and referenced in FIGS. 1–3, 8–10, 11(*b*)–14, 16, 17(*b*), 22, 23, and 25; and a first section arc length intermediate first section hinge end 13 and first section latch end 14 as may be seen from a general inspection of the noted drawing figures. Second bushing section 12 preferably comprises a second section hinge end 15 as illustrated and referenced in FIGS. 1, 2, 8–11(*a*), 12–14, 16, 17(*a*), 18, 19, 21, and 22; a second section latch end 16 as illustrated and referenced in FIGS. 1–3, 8–10, 11(*a*), 12–14, 16, 17(*a*), 18, 19, 21, and 22; and a second section arc length intermediate second section hinge end 15 and second section latch end 16 as may be seen from a general inspection of the noted drawing figures.

The hinge means may preferably be defined by comprising first section hinge knuckle structure 17 as illustrated in FIGS. 1, 2, 8–10, 12–14, 22, 23, and 25; second section hinge knuckle structure 18 as illustrated in FIGS. 1, 2, 9, 18, 19, and 21; and a hinge pin 19 as illustrated in FIGS. 1, 2, 5, 7, 8, 10, 12–14, and 22. It will be understood from an inspection of the noted drawing figures that first section hinge knuckle structure 17 is preferably integrally formed with first bushing section 11 adjacent first section hinge end 13. Similarly, second section hinge knuckle structure 18 is preferably integrally formed with second bushing section 12 adjacent second section hinge end 15.

First hinge knuckle structure 17 and second hinge knuckle structure 18 each further preferably comprise hinge pin-receiving structure or hinge pin-receiving shafts 20 both of which have been illustrated and referenced in FIG. 1. Hinge pin-receiving shaft 20 of first hinge knuckle structure 17 is illustrated and referenced in FIGS. 2, 23, and 25. Hinge pin-receiving shaft 20 of second hinge knuckle structure 18 is illustrated and referenced in FIGS. 9, 18, 19, and 21. The hinge pin-receiving structure or hinge pin-receiving shafts 20 have a common functional hinge pin axis as perhaps most clearly illustrated and referenced in FIG. 2 at reference numeral 21. Hinge pin 19 is thus insertable into the hinge pin-receiving structure for pivotally connecting first bushing section 11 to second bushing section 12. It will be noted that first bushing section 11 and second bushing section 12 are thus pivotable about a pivot axis when pivotally connected, the pivot axis being collinear with hinge pin axis 21.

Figure 5:
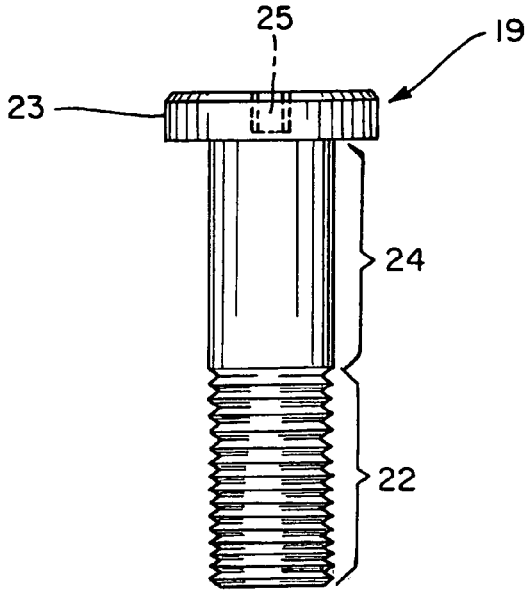
FIG. 5 is an enlarged side view of a hinge pin.

Hinge pin 19 preferably comprises a threaded end 22, a head end 23, and a smooth intermediate pin portion 24 all as referenced in FIGS. 1, 2, and 5. It will thus be understood from a consideration of the noted drawing figures that threaded end 22 is designed to be received in second section hinge knuckle structure 18. Hinge pin-receiving shaft 20 of second section hinge knuckle structure 18 is thus also preferably threaded to properly receive threaded end 22. The smooth intermediate pin portion 24 is received in hinge pin-receiving shaft 20 of first section hinge knuckle structure 17. First section hinge knuckle structure 17 preferably comprises a smooth bore to allow proper pivotal movement about the pivot axis. It will be further seen from an inspection of FIG. 1 that first section hinge knuckle structure 17 further preferably comprises a head—receiving portion to accommodate or receive head end 23. When hinge pin 19 is inserted into the axially-aligned, hinge pin-receiving structure as generally illustrated in FIG. 2, head end 23 should be seated in the head-receiving portion so as to allow pivotal movement. In other words, hinge pin 19 should not be tightened but threaded into second section hinge knuckle structure 18 so as to allow first section hinge knuckle structure 17 to freely pivot about smooth intermediate pin portion 24 without requiring significant torque. Head end 23 is thus designed to prevent first bushing section 11 from becoming otherwise removed from second bushing section 12. As illustrated in FIG. 1, and as illustrated and referenced in FIG. 5, head end 23 may comprise, for example, Allen wrench-receiving structure 25 for enabling the user to properly assembly hinge pin 19 in the hinge pin-receiving structure as here described. In FIGS. 7, 8, 10, 12–14, and 22, hinge pin 19 has been illustrated and referenced as a generic hinge pin 19 with no specific structural means for tightening hinge pin 19.

Figure 3:
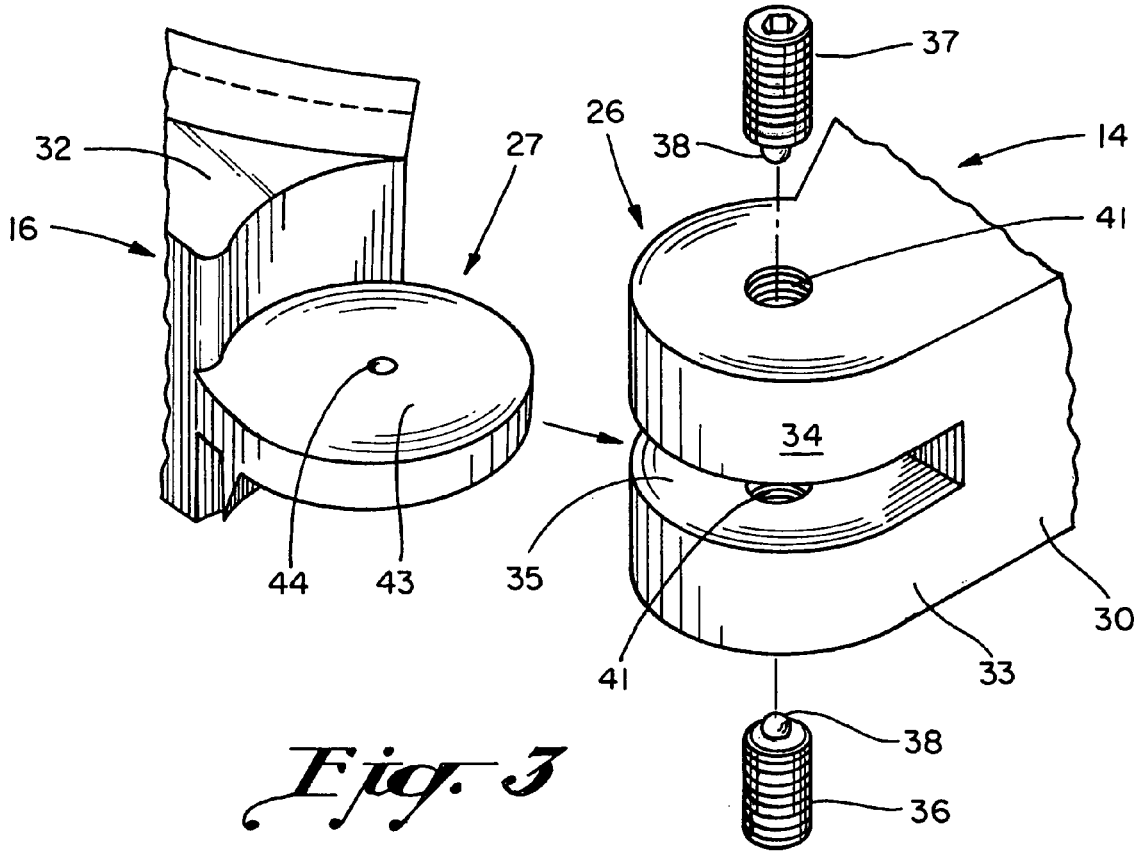
FIG. 3 is a fragmentary perspective view of the preferred embodiment of latch means for removably fastening a first section latch end to a second section latch end.

The latch means may preferably be defined by comprising first section latch knuckle structure 26 as referenced in FIG. 3; second section latch knuckle structure 27 as referenced in FIG. 3; and latch pin means. First section latch knuckle structure 26 is preferably integrally formed with first bushing section 11 adjacent first section latch end 14 and second section latch knuckle structure 27 is preferably integrally formed with second bushing section 12 adjacent second section latch end 16. First latch knuckle structure 26 and second latch knuckle structure 27 each preferably comprise latch pin-receiving structure, which collective structure has a latch pin axis 28 as referenced in FIGS. 1 and 2. Preferably, latch pin axis 28 is substantially parallel with the hinge pin axis 21.

First section latch knuckle structure 26 preferably comprises an inlet end latch knuckle 33 as illustrated in FIGS. 1–3; and an outlet end latch knuckle 34 as also illustrated in FIGS. 1–3. It will be seen from an inspection of the noted drawing figures that inlet end latch knuckle 33 is preferably in axially spaced relation to outlet end latch knuckle 34. In this last regard, it will be understood that inlet end latch knuckle 33 and outlet end latch knuckle 34 thus define a knuckle-receiving gap 35 as referenced in FIG. 3.

Figure 4:
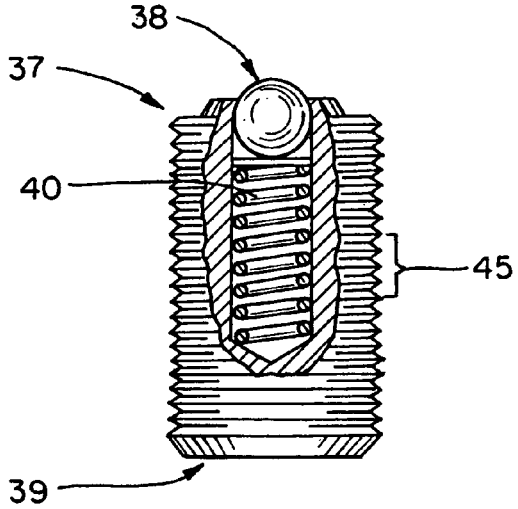
FIG. 4 is an enlarged side view of a ball plunger pin with parts removed to show internal spring means.

The latch pin means may preferably be defined by comprising an inlet end ball plunger 36 and an outlet end ball plunger 37 as illustrated and referenced in FIGS. 1–3, inclusive. FIG. 4 illustrates a detailed rendering of a typical ball plunger, such as outlet end ball plunger 37 as illustrated in FIG. 3. Inlet end ball plunger 36 and outlet end ball plunger 37 each preferably comprise a ball end 38 as illustrated in FIGS. 3 and 4; a head end 39 as illustrated in FIGS. 3 and 4; and spring means 40 for ball end displacement as specifically referenced in FIG. 4. Inlet end ball plunger 36 and outlet end ball plunger 37 are insertable in the latch pin-receiving structure such that the respective ball ends 38 extend into knuckle-receiving gap 35.

It should be noted that with regard to first section latch knuckle structure 26, the latch pin-receiving structure preferably comprises latch pin-receiving shafts 41 extending through inlet end latch knuckle 33 and outlet end latch knuckle 34 substantially as illustrated in FIG. 3. It will be further noted that latch pin-receiving shafts 41 are preferably threaded as are the exterior surfaces of inlet end ball plunger 36 and outlet end ball plunger 37.

Second section latch knuckle structure 27 preferably comprises an inlet end surface 42 as illustrated in FIGS. 1 and 2, and an outlet end surface 43 as illustrated in FIG. 3. Inlet end surface 42 and outlet end surface 43 each preferably comprise axially-aligned ball-receiving dimples 44 or sockets as illustrated in FIGS. 1–3. To close an otherwise openly pivoted grounding bushing, second section latch knuckle structure 27 is sized and shaped to be receivable in knuckle-receiving gap 35. During the process of receiving second section latch knuckle structure 27, respectively spaced ball ends 38 contact inlet end surface 42 and outlet end surface 43 and are subjected to compressive forces as said contact is made. Spring means 40 are thus compressed and allow the respective ball ends 38 to be oppositely displaced, and further translatable across inlet end surface 42 and outlet end surface 43 and ultimately seatable in the respective ball-receiving dimples 44. Once seated in ball-receiving dimples 44, first section latch end 14 is effectively removably fastened to second section latch end 16. Notably, inlet end ball plunger 36 and outlet end ball plunger 37 each preferably comprise spring lock means 45 as referenced in FIG. 4, which function to selectively prevent ball end displacement. Thus, when desired by the installer, spring lock means 45 may be engaged to selectively lock first section latch end 14 to second section latch end 16. Thus, it will be understood that the latch pin means as here specified are insertable into the latch pin-receiving structure for removably fastening first section latch end 14 to second section latch end 16.

By removably fastening first section latch end 14 to second section latch end 16, the first section arc length and the second section arc lengths function to cooperatively form an annular, dual-sectioned, grounding bushing as may be appreciated from a general consideration of FIGS. 1 and 2. As illustrated throughout the drawing figures, first bushing section 11 and second bushing section 12 comprise a first section arc length and a second section arc length, which have been illustrated as being substantially equal in magnitude. Preferably the first and second section arc lengths are of substantially equal magnitudes. However, it should be noted that grounding bushing assembly 10 may be constructed from first bushing section 11 and second bushing section 12 comprising first and second arc lengths of varying magnitudes. So long as the arc length of smallest magnitude (when pivoted to an open state) will allow finally connected electrical conductors to be radially directed into the inner annular portion of the grounding bushing, the arc length of the smallest magnitude will suffice to render the resulting grounding bushing assembly effective. That is, installers will still be able to install the resulting grounding bushing assembly 10 around finally connected electrical conductors.

It will thus be seen that the resulting grounding bushing preferably comprises an inner annular surface 29 as illustrated in FIGS. 1, 2, 8–11(*a*), 12–14, 16–19, and 21–24; an outer annular surface 30 as illustrated in FIGS. 1–3, 7–10, 11(*b*)–14, 16, 19, 22, 24, and 25; a conductor inlet end 31 as referenced in FIGS. 1, 2, 6–14, 16–19, 21–25; and a conductor outlet end 32 as referenced in FIGS. 1–3, 6–14, 16–18, and 21–25. Inner annular surface 29 preferably comprises a conductive contact ridge 49 as illustrated and referenced in FIGS. 1, 2, 8, 9, 11*a*, 12, 13, 16, and 17*b*. Conductive contact ridge 49 is essentially an inner annular protuberance designed to maximize or increase electrical communication between the grounding bushing and conduit terminus 1000.

It is further contemplated that grounding bushing assembly 10 may comprise an annular flange 50 as illustrated and referenced in FIGS. 1 and 2. Annular flange 50 is preferably spatially located adjacent inner annular surface 29 and conductor outlet end 32 and is preferably constructed from electrically insulative materials. Further, it is contemplated that the outer annular surface 30 of grounding bushing assembly 10 may preferably be outfitted with or comprise a plurality of circumferentially spaced, axially-aligned, section-reinforcing ribs 51 as generically illustrated and referenced in FIGS. 22 and 25.

It will be understood that the resulting grounding bushing comprises a bushing axis, which essentially defines the axial alignment of the resulting grounding bushing and thus may be described as the line extending through a central bushing point, the central bushing point being that point equidistant from inner annular surface 29. Thus, it will be understood that the bushing axis is substantially parallel to the latch pin axis 28 as well as the hinge pin axis 21 in the preferred embodiment.

Conductor inlet end 31 is thus designed for attachment to conduit terminus 1000 as illustrated and referenced in FIG. 6 and thus receives at least one electrical conductor 1002, which electrical conductor 1002 exits conduit terminus 1000. The electrical conductor or conductors 1002 are typically fed through conduit terminus so as to be finally and electrically connected to connection points 1003 or other similar structure adjacent conduit terminus 1000. Grounding bushing assembly 10 as thus specified is designed to enable an installer to install the same either before or after electrical connections are finalized by (1) either feeding unconnected electrical conductors 1002 through the grounding bushing assembly 10 when in an annular configuration (before electrical connections are finalized) or by (2) feeding an open-pivoted grounding bushing assembly 10 around connected electrical conductors 1002 (after electrical connections are finalized) and pivoting closed the open grounding bushing assembly 10 to an annular configuration for attachment to conduit terminus 1000.

In sum, grounding bushing assembly 10 preferably comprises first bushing section 11, second bushing section 12, the hinge means, and the latch means. First bushing section 11, second bushing section 12, hinge means, and latch means are all preferably constructed from electrically conductive materials. It is noted that electrical conductors are materials in which electric charges move freely (metals are good conductors) and electrical insulators are materials in which electric charges cannot move freely (glass, rubber, and wood are good insulators). Preferably the components as identified and included by the terms listed above are constructed from steel, which material provides a low cost, conductive material with sufficient strength out of which the components may be constructed. First bushing section 11, second bushing section 12, the hinge means, and the latch means, being constructed from electrically conductive materials, are thus electrically communicative with one another allowing electric charges to migrate through the material.

Figure 7:
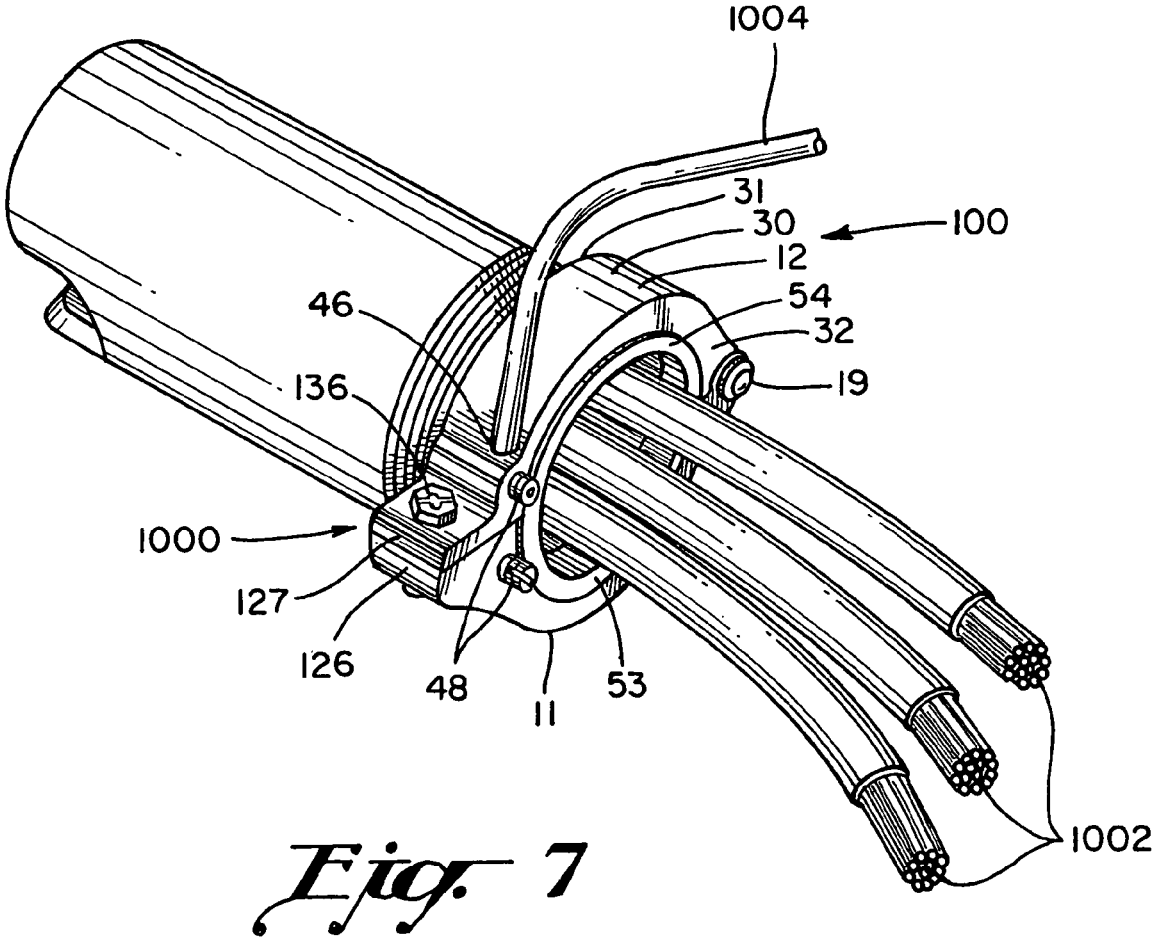
FIG. 7 is a perspective view of a first alternative embodiment of the grounding bushing assembly installed on a conduit terminus showing electrical conductors exiting the conduit terminus and a ground conductor leading away from the grounding bushing assembly.
Figure 11A:
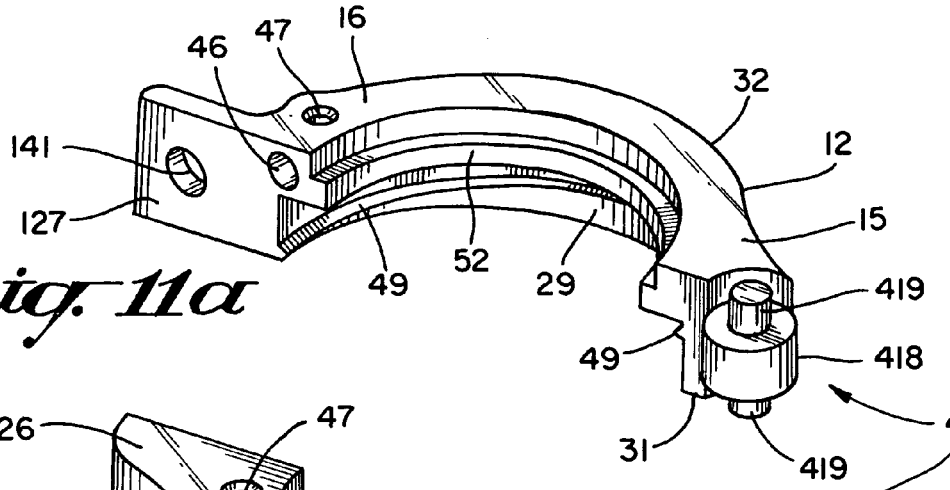
FIG. 11(*a*) is a perspective view of a second bushing section of a fourth alternative embodiment of the grounding bushing assembly as viewed from a conductor outlet end.
Figure 11B:
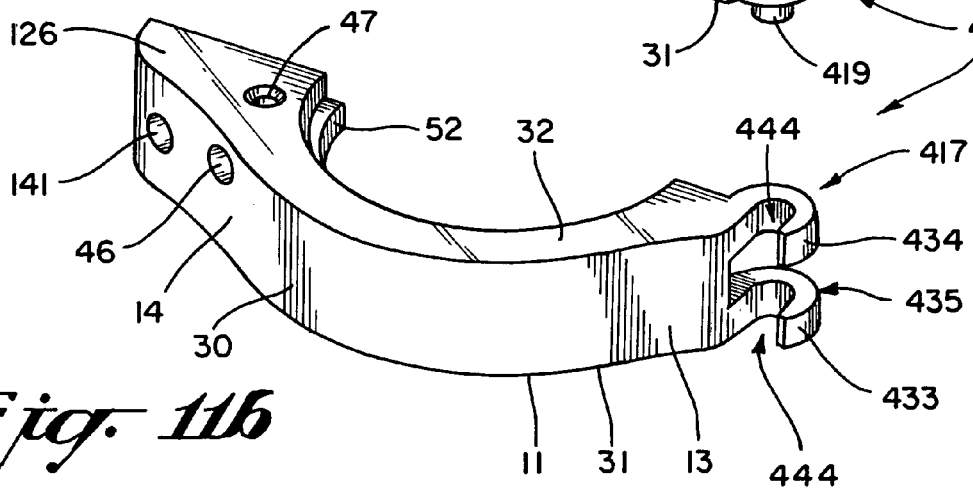

Grounding bushing assembly 10 may further preferably comprise ground conductor attachment means which further function to allow electric charges to migrate from grounding bushing assembly 10 to a ground conductor, which ground conductor leads to ground or the Earth. FIG. 7 generally depicts a ground conductor 1004 attached to a grounding bushing (alternative embodiment) via ground conductor attachment means. In this last regard, it will be understood that the ground conductor attachment means may be defined by a ground conductor-receiving tunnel 46 as referenced in FIGS. 7, 11(*a*)–14, 16–18, and 21; set screw-receiving structure 47 as illustrated in FIGS. 11(*a*), 11(*b*), 17(*a*), and 17(*b*); and at least one, but preferably two set screws 48 as illustrated in FIGS. 7, 12–14, and 16. Ground conductor-receiving tunnel 46 may be formed through the grounding bushing adjacent the latch means as has been generally shown on a plurality of alternative embodiments in FIGS. 7, 11(*a*)–14, 16–18, and 21. In the preferred embodiment ground conductor-receiving tunnel 46 has a tunnel axis, which may be substantially orthogonal to (albeit spaced from) the bushing axis. As will be seen from a general inspection of FIG. 7, ground conductor-receiving tunnel 46 is designed to receive a ground conductor 1004. The set screw-receiving structure 47 preferably comprises two set screw-receiving shafts, one formed in each of the first section latch end 14 and the second section latch end 16. Alternative embodiments of the present invention show a set screw-receiving shaft adjacent the latch means in each of a first section latch end and a second latch end (as referenced by reference numeral 47) and have been specifically illustrated in FIGS. 11(*a*), 11(*b*), 17(*a*), and 17(*b*). It will be seen from an inspection of the noted figures that set screw-receiving structure 47 preferably orthogonally intersects ground conductor-receiving tunnel 46 and are each preferably threaded. A threaded set screw or set screws 48 are then removably insertable in the set screw-receiving structure 47 for removably attaching ground conductor 1004 to the given grounding bushing.

It is further, contemplated, however, that the ground conductor attachment means may further be preferably defined by a substantially C-shaped ground conductor-receiving structure 1100 as generally illustrated and referenced in FIGS. 26–31. C-shaped ground conductor-receiving structure 1100 preferably comprises a spine 1101 as illustrated and referenced in FIGS. 27, and 29–31; a superior C portion 1102 as illustrated and referenced in FIGS. 26–31; and an inferior C portion 1103 as illustrated and referenced in FIGS. 29–31. Notably, spine 1101 is preferably integrally formed with or otherwise fixedly attached to the outer annular surface of either the first bushing section (as generally depicted in FIGS. 26–30) of the grounding bushing assembly or the second bushing section of the grounding bushing assembly. It will thus be seen from an inspection of the noted figures that spine 1101, superior C portion 1102, and inferior C portion 1103 together defined a ground conductor-receiving groove as referenced at 1104 in FIGS. 27, and 29–31. Ground conductor-receiving groove 1104 is thus preferably sized and shaped to receive a ground conductor, the longitudinal axis of which is readily received by groove 1104.

Figure 26:
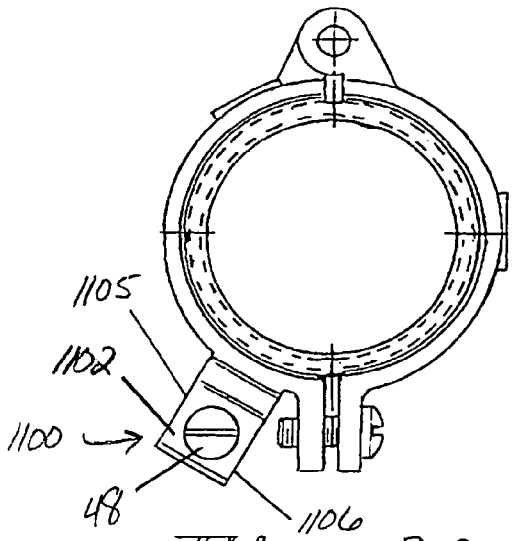
FIG. 26 is a top plan view of a tenth alternative embodiment of the grounding bushing assembly in an assembled state as viewed from a conductor outlet end, showing a preferred ground conductor attachment structure.
Figure 27:
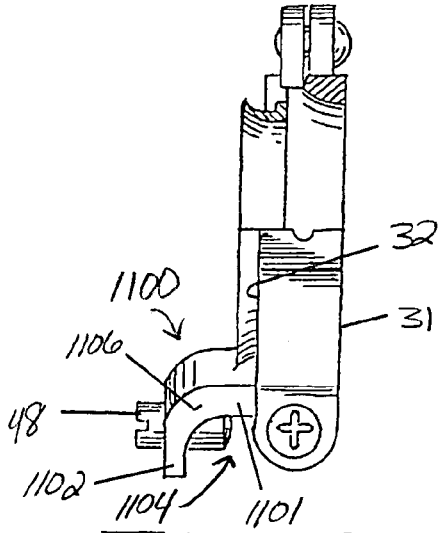
FIG. 27 is a side plan view of the alternative grounding bushing assembly shown in FIG. 26.
Figure 28:
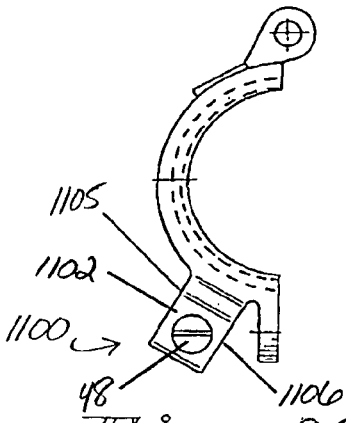
FIG. 28 is a plan view of a first bushing section of the alternative grounding bushing assembly as viewed from the conductor outlet end.
Figure 29:
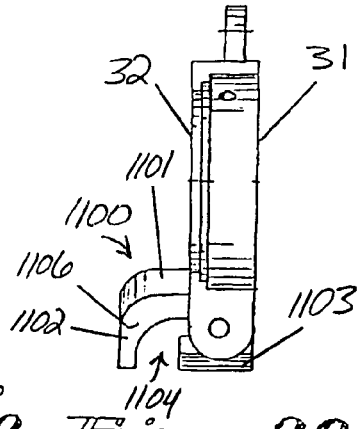
FIG. 29 is a side plan view of the first bushing section shown in FIG. 28 as viewed from an inner annular surface thereof.
Figure 30:
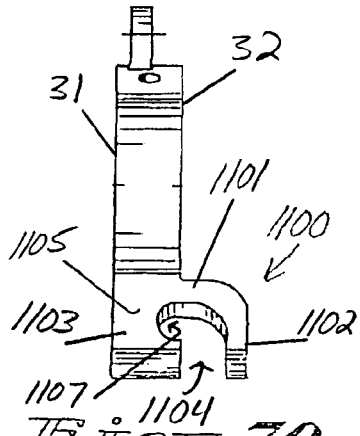
FIG. 30 is a side plan view of the first bushing section shown in FIG. 28 as viewed from an outer annular surface thereof.
Figure 31:
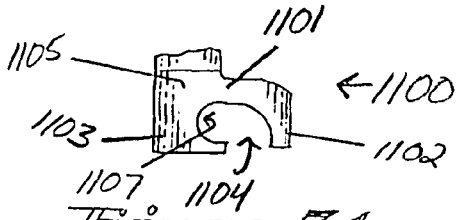
FIG. 31 is side view of a preferred ground conductor attachment structure of the alternative grounding bushing assembly.

From an inspection of FIGS. 26 and 28, it will be seen that ground conductor-receiving structure 1100 has a certain thickness when viewed from a top plan view. Thus, it will be further understood that ground conductor-receiving structure 1100 preferably comprises a substantially planar first face 1105 as referenced in FIGS. 26, 28, 30, and 31; and a substantially planar second face 1106 as referenced in FIGS. 26–29. It will be readily noted that a ground conductor has a substantially linear longitudinal axis extending through the center thereof when the ground conductor is straightened. When ground conductor-receiving groove 1104 receives a ground conductor, the longitudinal axis of the ground conductor extends substantially orthogonally to first and second planar faces 1105 and 1106. It will be further noted from an inspection of FIGS. 26–28 that superior C portion 1102 of ground conductor-receiving structure 1100 preferably further comprises a set screw-receiving structure for receiving a set screw 48. Set screw 48 as referenced in FIGS. 26–28 functions to fix more proper contact between a ground conductor and the grounding bushing assembly for enabling more proper grounding.

It will thus be seen (perhaps most readily from an inspection of FIGS. 26 and 28) that superior C portion 1102 preferably extends radially outward from the grounding bushing assembly and that inferior C portion 1103 extends radially outward and further extends towards superior C portion 1102 such that the superior most region of inferior C portion 1103 lies in or substantially adjacent the plane in which conductor outlet end 32 lies. From an inspection of FIGS. 27, and 29–31 it will be seen that ground conductor-receiving structure 1100 preferably comprises a certain height as measured from the superior most portion of superior C portion 1102 to the inferior most portion of inferior C portion 1103. It will be further seen from an inspection of the noted figures that the preferred height of ground conductor-receiving structure 1100 is preferably on the order of twice the magnitude of the distance from conductor inlet end 31 to conductor outlet end 32. Thus, it will be seen that ground conductor-receiving groove 1104 preferably comprises a conductor seat 1107 (as referenced in FIGS. 30 and 31), the inferior most portion of which is structurally situated intermediate conductor inlet end 31 and conductor outlet end 32 (the inferior most portion being defined as that portion closest to the plane in which conductor inlet end 31 lies).

It is contemplated that ground conductor attachment structure 1100, as thus described, is the preferred structural teaching of the ground conductor attachment means for use in combination with the grounding bushing assembly. In keeping with the ease of installation notions earlier described, it is believed that ground conductor attachment structure 1100 functions to enable ground conductor installers to otherwise attach a ground conductor to the grounding bushing assembly even if either end of the ground conductor is unavailable for threaded insertion through a ground conductor receiving tunnel. In other words, if either end of the ground conductor has been fixedly attached, it is not necessary to detach either end of the ground conductor in order to affix the same to the grounding bushing assembly, provided the ground conductor has sufficient slack to be translated laterally into ground conductor-receiving groove 1104, and ultimately set (via set screw 48) into conductor seat 1107.

Thus, the preferred ground conductor attachment means are defined by a substantially C-shaped ground conductor-receiving structure, the conductor-receiving structure for removably attaching a ground conductor to the grounding bushing or grounding bushing assembly. The conductor-receiving structure comprises a spine, a superior C portion, and an inferior C portion, the spine being fixedly attached to the outer annular surface of the grounding bushing assembly. The spine, superior C portion, and inferior C portion together define a ground conductor-receiving groove, which groove is sized and shaped to receive a ground conductor for removably attaching a ground conductor to the grounding bushing assembly.

The conductor-receiving structure may further comprise a substantially planar first face, a substantially planar second face, and a structural thickness intermediate the first face and the second face. The conductor-receiving groove has a groove axis substantially collinear with the longitudinal axis of a set ground conductor. Thus, the groove axis is substantially orthogonal to the first face and the second face. The superior C portion comprises ground conductor set means for fixedly setting a ground conductor in contact with the grounding bushing assembly for enabling more proper grounding. The ground conductor set means may preferably be defined by set screw-receiving structure (formed in superior C portion) and a set screw cooperatively associated with (threadably received in) the set screw-receiving structure. Notably, the superior C portion extends radially outward from the grounding bushing assembly and the inferior C portion extends radially outward and towards the superior C portion. So structurally configured, the conductor-receiving groove thus comprises a conductor seat structurally situated intermediate the conductor inlet end and the conductor outlet end for decreasing the migratory distance for electrical charges or the "charge migratory distance" from the grounding bushing assembly to the ground conductor. The ground conductor attachment means are thus designed for removably attaching a ground conductor to the grounding bushing assembly and further for enabling an installer to install the grounding bushing assembly either before or after electrical connections are finalized.

Alternative Embodiment No. 1

Figure 12:
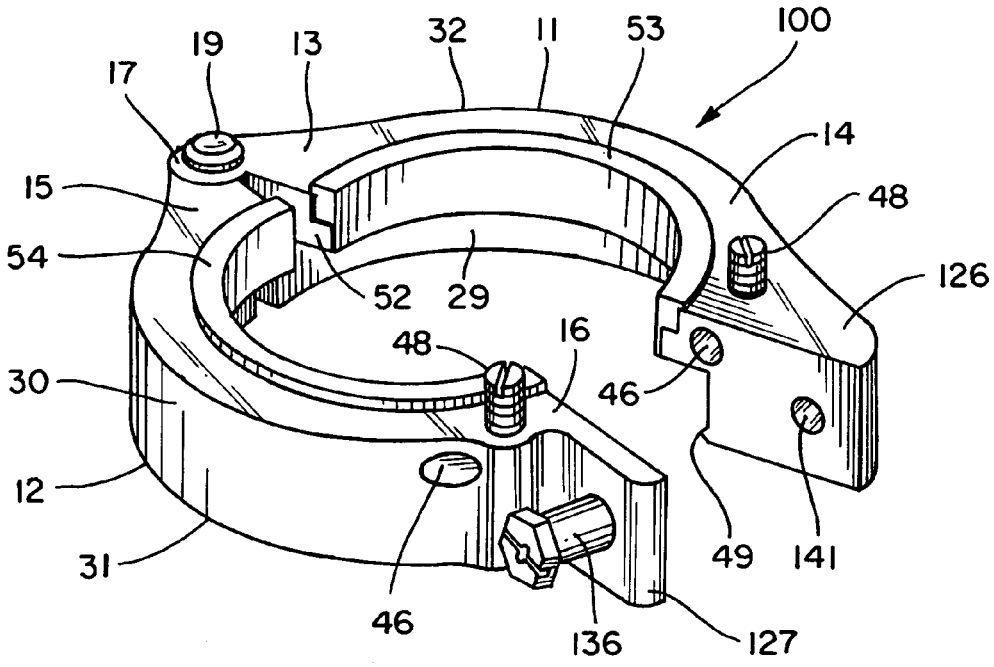
FIG. 12 is a perspective view of the first alternative embodiment of the grounding bushing assembly in a pivoted open state as viewed from a conductor outlet end.
Figure 13:
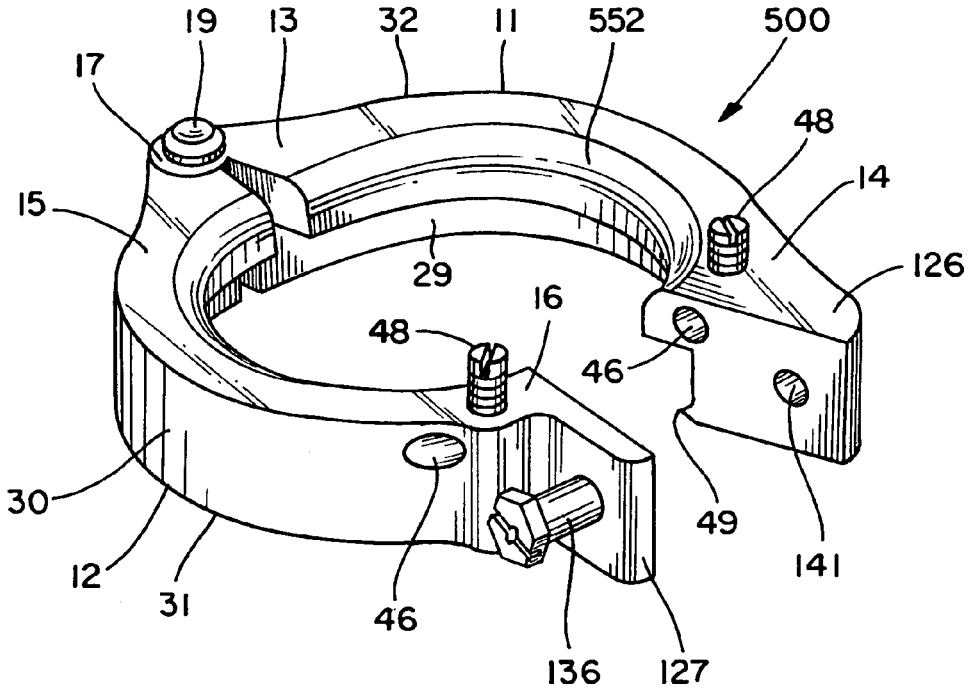
FIG. 13 is a perspective view of a fifth alternative embodiment of the grounding bushing assembly in a pivoted open state as viewed from a conductor outlet end.

A first alternative embodiment of the present invention also concerns a dual-sectioned grounding bushing assembly, which grounding bushing assembly is illustrated and referenced at 100 in FIGS. 7 and 12. Grounding bushing assembly 100 is substantially similar to grounding bushing assembly 10 save for certain structural differences as embodied in the latch means and inner annular surface 29.

From an inspection of FIGS. 7 and 12 it will be noted that the latch means of grounding bushing assembly 100 differs from the latch means of grounding bushing assembly 10 in several key respects. The latch means of grounding bushing assembly 100 may be described by the following specifications.

The latch means of grounding bushing assembly 100 preferably comprises first section latch structure 126 as illustrated and referenced in FIGS. 7, 12–14, 16, and 17(*b*); second section latch structure 127 as illustrated and referenced in FIGS. 7, 12–14, 16, 17(*a*), 18, 19, and 21; and a latch pin 136 as illustrated and referenced in FIGS. 7, 12–14, and 16. It will thus be noted that first section latch structure 126 is preferably integrally formed with first bushing section 111 adjacent first section latch end 14. Second section latch structure 127 is preferably integrally formed with second bushing section 12 adjacent second section latch end 16. First section latch structure 126 and second section latch structure 127 each preferably comprise latch pin-receiving structure, which latch pin-receiving structure may be defined by a latch pin-receiving shaft 141 as referenced in FIGS. 11(*a*)–14, and 16–18. Only the latch pin-receiving shaft 141 of first section latch structure 126 has been referenced in FIGS. 12–14, and 16 since the latch pin-receiving structure of second section latch structure 127 has latch pin 136 removably inserted therein. It is further contemplated that latch pin 136 and latch pin-receiving shafts 141 may comprise threads for effecting more secure removable attachment of first section latch end 14 to second section latch end 16.

It will thus be noted that the latch pin-receiving structure has a latch pin axis extending through latch pin 136 when latch pin 136 is removably inserted into the latch pin-receiving structure for removably fastening first section latch end 14 to second section latch end 16. It will thus be seen that the latch pin axis of the first alternative embodiment is spatially oriented so as to be orthogonal to (albeit spaced from) the bushing axis.

As in the preferred embodiment, the first and second section arc lengths of the first alternative embodiment function to cooperatively form an annular, dual-sectioned grounding bushing, which grounding bushing comprises inner annular surface 29, outer annular surface 30, conductor inlet end 31, conductor outlet end 32, and a bushing axis. In the first alternative embodiment, it will be seen, however, that the bushing axis is substantially parallel only to the hinge post axis and not the latch pin axis.

Further, inner annular surface 29 of the first alternative embodiment preferably comprises a circumferential seat flange 52 as illustrated and referenced in FIGS. 8–12, 14, 16–19, 21–25. As will be understood from an inspection of the noted drawing figures, seat flange 52 is spatially located intermediate conductor inlet end 31 and conductor outlet end 32. Seatable upon seat flange 52 is a further component of grounding bushing assembly 100, namely a dual-sectioned insulative bushing member. The insulative bushing member preferably comprises a first insulative section 53 as illustrated and referenced in FIGS. 7, 8–10, 12, 14, 16, and 22; and a second insulative section 54 as illustrated and referenced in FIGS. 7–10, 12, 14, 16, and 22. First insulative section 53 and second insulative section 54 each comprise a first insulative end, a second insulative end, and an insulative arc length intermediate the first insulative end and the second insulative end. The first and second insulative sections thus function to cooperatively form an annular, dual-sectioned bushing member. The resulting bushing member is preferably sized and shaped to snugly seat upon seat flange 52 and is preferably constructed from electrically insulative materials.

As illustrated throughout the drawing figures, first insulative section 53 and second insulative section 54 each comprise an insulative arc length, which have been illustrated as being substantially equal in magnitude. Preferably the first and second insulative arc lengths are of substantially equal magnitudes. However, it should be noted that grounding bushing assembly 100 may be constructed from first insulative section 53 and second insulative section 54 comprising first and second insulative arc lengths of varying magnitudes according to the reasoning as outlined for the first and second section arc lengths of the first and second bushing sections 11 and 12 as previously specified herein.

Alternative Embodiment No. 2

Figure 8:
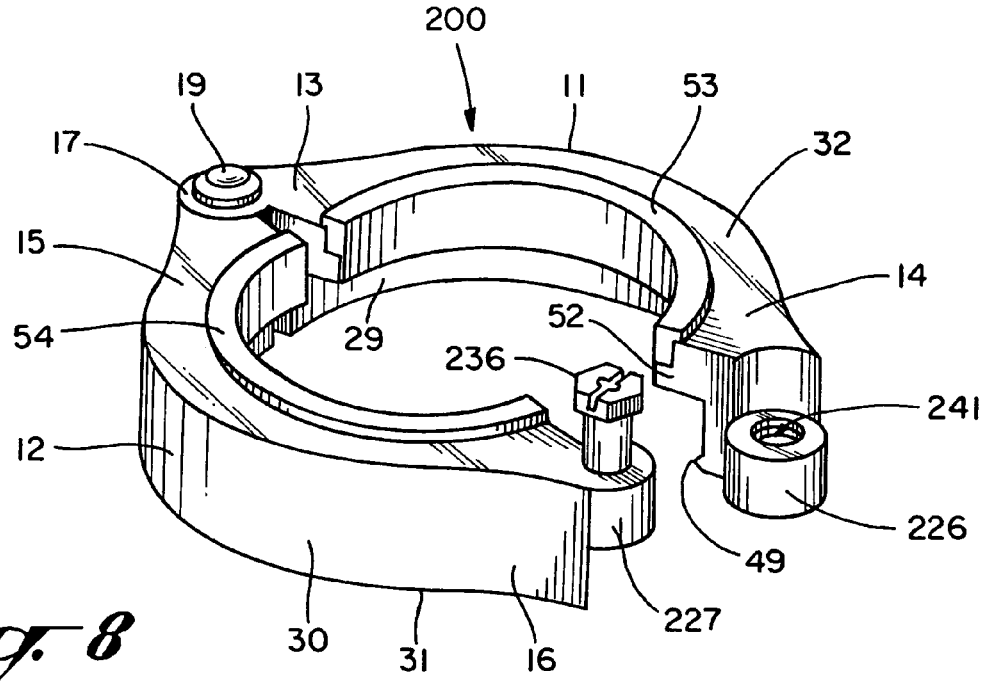
FIG. 8 is a perspective view of a second alternative embodiment of the grounding bushing assembly in a pivoted open state as viewed from a conductor outlet end.
Figure 9:
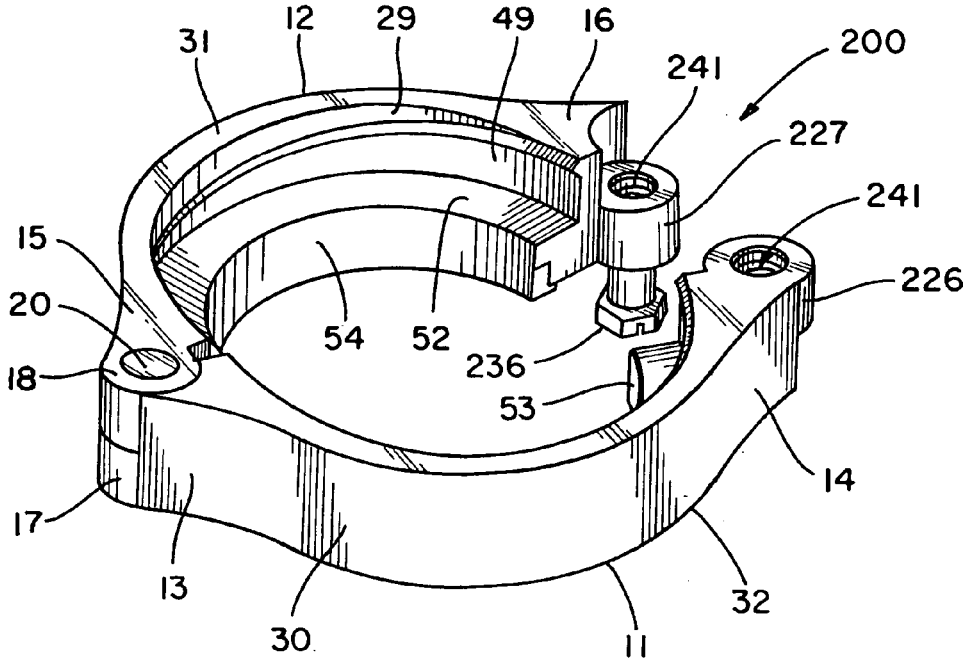
FIG. 9 is a perspective view of the alternative embodiment of FIG. 8 in a pivoted open state as viewed from a conductor inlet end.

A second alternative embodiment of the present invention concerns a grounding bushing assembly 200 as illustrated and referenced in FIGS. 8 and 9. Grounding bushing assembly 200 is substantially identical to grounding bushing assembly 100 save for certain features as identified in the latch means. In this regard, it will be seen that the latch means of grounding bushing assembly 200 preferably comprises first section latch structure 226, second section latch structure 227, and at least one latch pin 236 all as illustrated and referenced in FIGS. 8 and 9. It will be seen from an inspection of the noted drawing figures that first section latch structure 226 is preferably integrally formed with first bushing section 11 adjacent first section latch end 14 and that second section latch structure 227 is preferably integrally formed with second bushing section 12 adjacent second section latch end 16. First section latch structure 226 and second section latch structure 227 each preferably comprise latch pin-receiving structure, which may be defined by latch pin-receiving shafts 241, one of which has been illustrated and referenced in FIG. 8 (the latch pin-receiving shaft of first section latch structure 226) and both of which have been illustrated in FIG. 9.

It will thus be understood that the latch pin-receiving structure of grounding bushing assembly 200 has a preferred latch pin axis when the latch pin-receiving structure is axially aligned, which latch pin axis extends through latch pin 236. Latch pin 236 is designed for removable insertion into the latch pin-receiving structure for removably fastening first section latch end 14 to second section latch end 16.

In this regard, it is contemplated that latch pin 236 and latch pin-receiving shafts 241 may comprise threads for effecting more secure removable attachment of first section latch end 14 to second section latch end 16. As before, the first and second section arc lengths thus cooperatively form an annular, dual-sectioned grounding bushing, the grounding bushing comprising inner annular surface 29, outer annular surface 30, conductor inlet end 31, conductor outlet end 32, and a bushing axis. In the second alternative embodiment, it is thus contemplated that the bushing axis is substantially parallel not only to the hinge pin axis, but also the latch pin axis.

Alternative Embodiment No. 3

Figure 10:
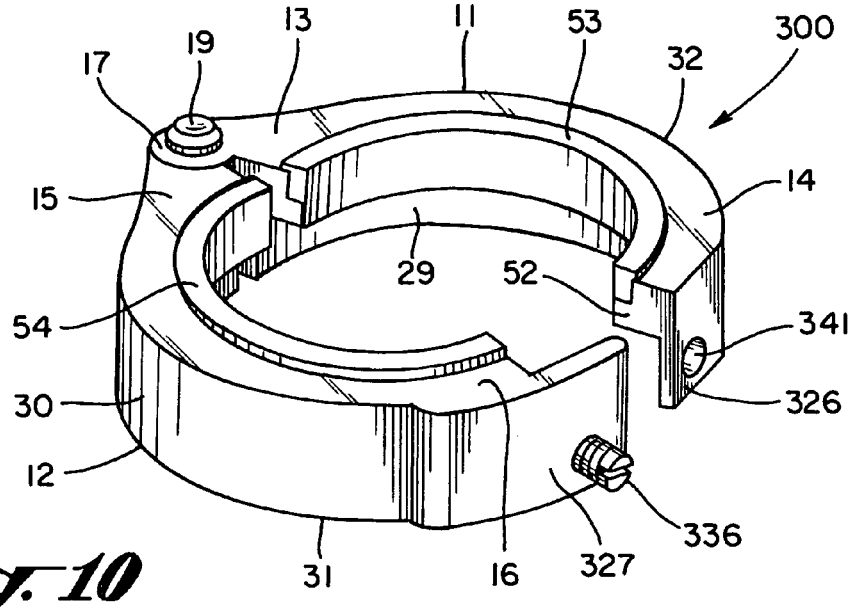
FIG. 10 is a perspective view of a third alternative embodiment of the grounding bushing assembly in a pivoted open state as viewed from a conductor outlet end.

A third alternative embodiment of the present invention concerns a grounding bushing assembly 300 as has been generally illustrated and referenced in FIG. 10. Grounding bushing assembly 300 is substantially identical to grounding bushing assembly 100 and grounding bushing assembly 200 save for certain features as identified in the latch means. In this regard, it will be seen that the latch means of grounding bushing assembly 300 preferably comprises first section latch structure 326, second section latch structure 327, and at least one latch pin 336 all as illustrated and referenced in FIGS. 10 and 22.

It will be seen from an inspection of the noted drawing figure that first section latch structure 326 is preferably integrally formed with first bushing section 11 adjacent first section latch end 14 and that second section latch structure 327 is preferably integrally formed with second bushing section 12 adjacent second section latch end 16. First section latch structure 326 and second section latch structure 327 each preferably comprise latch pin-receiving structure, which may be defined by latch pin-receiving shafts 341, one of which has been illustrated and referenced in FIG. 10 (the latch pin-receiving shaft 341 of first section latch structure 326). Latch pin 336 is shown removably inserted in latch pin-receiving shaft 341 of second section latch structure 327.

It will thus be understood that the latch pin-receiving structure of grounding bushing assembly 300 has a preferred latch pin axis when the latch pin-receiving structure is axially aligned, which latch pin axis extends through latch pin 336. Latch pin 336 is designed for removable insertion into the latch pin-receiving structure for removably fastening first section latch end 14 to second section latch end 16. In this regard, it is contemplated that latch pin 336 and latch pin-receiving shafts 341 may comprise threads for effecting more secure removable attachment of first section latch end 14 to second section latch end 16. As before, the first and second section arc lengths thus cooperatively form an annular, dual-sectioned grounding bushing, the grounding bushing comprising inner annular surface 29, outer annular surface 30, conductor inlet end 31, conductor outlet end 32, and a bushing axis. In the third alternative embodiment, it is thus contemplated that the bushing axis is substantially parallel only with the hinge pin axis. The latch pin axis of grounding bushing assembly 300 is notably substantially orthogonal to the bushing axis as well as the hinge pin axis.

Alternative Embodiment No. 4

A fourth alternative embodiment of the present invention concerns a grounding bushing assembly 400 as has been generally illustrated and referenced in FIGS. 11(*a*) and 11(*b*), inclusive. FIG. 11(*a*) illustrates second bushing section 12 with its alternative structural contribution to the hinge means and FIG. No. 11(*b*) illustrates first bushing section 11 with its alternative structural contribution to the hinge means. Grounding bushing assembly 400 is substantially identical to grounding bushing assembly 100 save for certain features as identified in the hinge means. In this regard, it will be seen that the hinge means of grounding bushing assembly 400 preferably comprises first section hinge knuckle structure 417 as illustrated and referenced in FIG. 11(*b*); second section hinge knuckle structure 418 as illustrated and referenced in FIG. 11(*a*); and a fixed hinge post 419 as illustrated and referenced in FIG. 11(*a*). First section hinge knuckle structure 417 preferably comprises an inlet end hinge knuckle 433 and an outlet end hinge knuckle 434 as further illustrated and referenced in FIG. 11(*b*). First section hinge knuckle structure 417 is preferably integrally formed with first bushing section 11 adjacent first section hinge end 13. Similarly, second section hinge knuckle structure 418 is preferably integrally formed with second bushing section 12 adjacent second section hinge end 15. Hinge post 419 is preferably integrally formed with second hinge knuckle structure 418 such that two linearly aligned posts extend from second hinge knuckle structure, one toward conductor inlet end 31 and the second toward conductor outlet end 32 substantially as illustrated in FIG. 11(*b*). It will thus be understood that hinge post 419 has a hinge post axis, which post axis extends through the linearly aligned posts. Inlet end hinge knuckle 433 and outlet end hinge knuckle 434 further preferably comprise hinge post-receiving structure as referenced at 444 in FIG. 11(*b*). Hinge post-receiving structure 444 is cooperatively associated with hinge post 419 for pivotally connecting first bushing section to the second bushing section.

In this last regard, it will be seen from an inspection of the noted drawing figures that inlet end hinge knuckle 433 is structurally related to outlet end hinge knuckle 434 by being axially spaced along an axis extending through the hinge post-receiving structure. It will thus be further understood that inlet end hinge knuckle 433 and outlet end hinge knuckle 434 define a hinge knuckle-receiving gap 435 as is illustrated and referenced in FIG. 11(*b*). Second hinge knuckle structure 418 is thus receivable in the hinge knuckle-receiving gap and hinge post 19 is receivable in hinge post-receiving structure 444. First bushing section 11 and second bushing section 12 are thus pivotable about a pivot axis when pivotally connected, the pivot axis being collinear with the hinge post axis.

Alternative Embodiment No. 5

A fifth alternative embodiment of the present invention concerns a grounding bushing assembly 500 as has been generally illustrated and referenced in FIGS. 11(*a*) and 11(*b*). Grounding bushing assembly 400 is substantially identical to grounding bushing assembly 100 save for certain features as identified intermediate conductor inlet end 31 and conductor outlet end 32. It will be recalled that grounding bushing 100 comprises a circumferential seat flange 52 as illustrated and referenced in FIGS. 8–12, 14, 16–19, 21–25. Grounding bushing assembly 500 eliminates this structure (as well as the dual-sectioned insulative bushing member), and incorporates an annular beveled surface 552 intermediate conductor inlet end and conductor outlet end 32 adjacent inner annular surface 29 substantially as illustrated and referenced in FIG. 13. It is contemplated that annular beveled surface 552 functions to provide a smoother transition between inner annular surface 29 and conductor outlet end 32 so as to reduce the likelihood of damage to electrical conductors passing through grounding bushing assembly 500.

Alternative Embodiment No. 6

Figure 14:
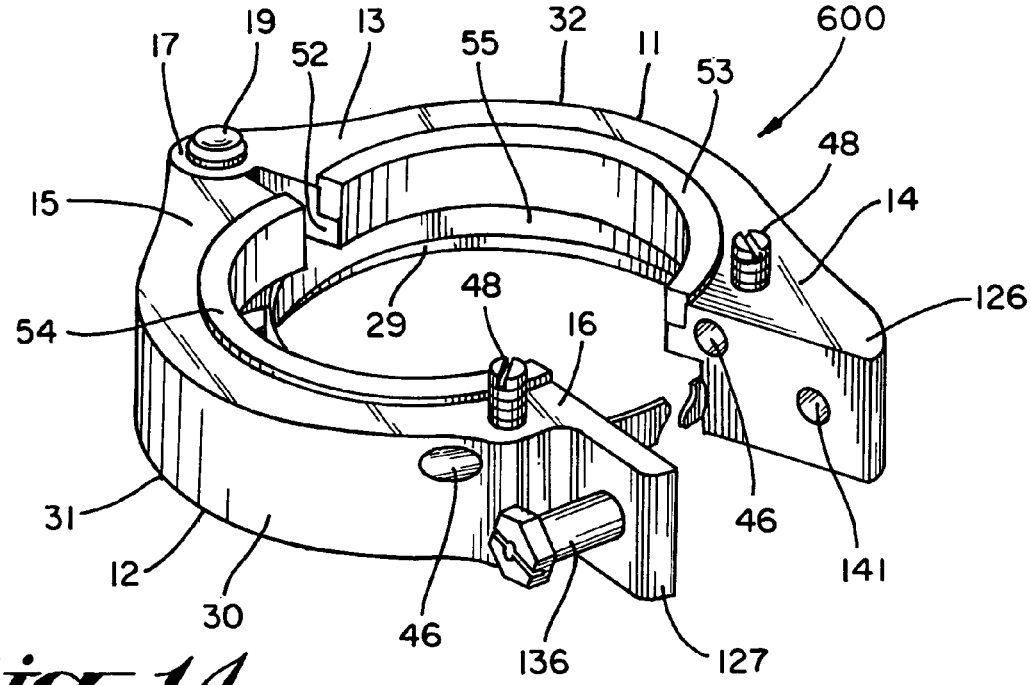
FIG. 14 is a perspective view of a sixth alternative embodiment of the grounding bushing assembly in a pivoted open state as viewed from a conductor outlet end.

A sixth alternative embodiment of the present invention concerns a grounding bushing assembly 600 as has been generally illustrated and referenced in FIG. 14. Grounding bushing assembly 600 is substantially identical to grounding bushing assembly 100 save for the addition of certain features to inner annular surface 29. In this regard, grounding bushing assembly 600 preferably comprises select compression ring structure, the select compression ring structure being selected from the group consisting of a gapped compression ring 55 as illustrated and referenced in FIGS. 14 and 15(*a*) and a dual-sectioned compression ring 56 as illustrated and referenced in FIG. 15(*b*). Gapped compression ring 55 allows the installer at his or her election to place gapped compression ring 55 around finally connected electrical conductors by passing the same through the compression ring gap 57 as referenced in FIG. 15(*a*). Dual-sectioned compression ring 56 functions in a similar way to allow the installer to place ring 56 around finally connected electrical conductors by passing electrical conductors through either of compression ring openings 58 (see FIG. 15(*b*)) before pivoting closed grounding bushing assembly 600 for installation on conduit terminus 1000. It is contemplated that both gapped compressive ring 55 and dual-sectioned compressive ring 56 are constructed from electrically conductive materials and that inner annular surface 29 has ring-accepting structure for retaining either of the ring structures in place when in an assembled state. It is contemplated, for example, that ring-accepting structure may be defined by a series of spot welds or by a ring-accepting groove.

Figure 15A:
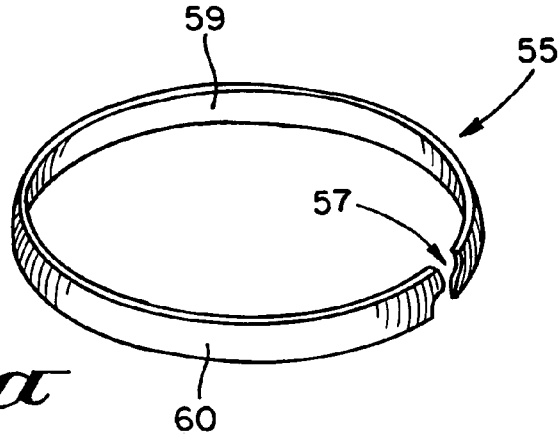
FIG. 15(*a*) is a perspective view of a gapped compression ring for use in combination with the sixth alternative embodiment of the grounding bushing assembly.
Figure 15B:
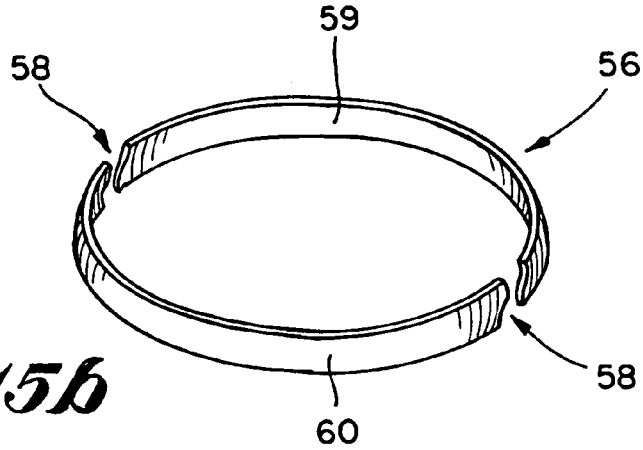
Figure 16:
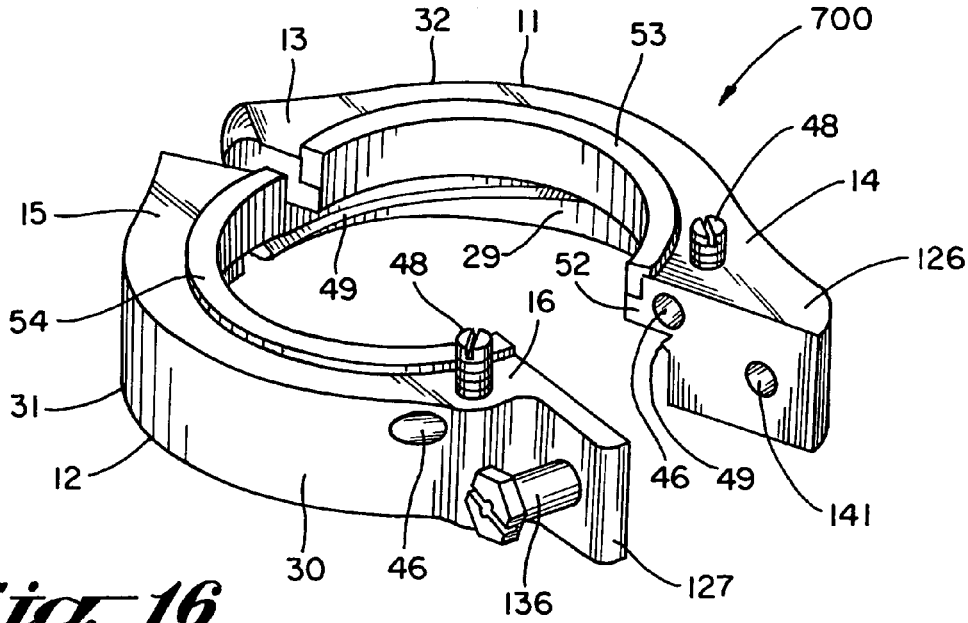
FIG. 16 is a perspective view of a seventh alternative embodiment of the grounding bushing assembly in a pivoted open state as viewed from a conductor outlet end.

In any case, both gapped compression ring 55 and dual-sectioned compression ring 56 preferably comprise a concave inner ring surface 59 and a convex outer ring surface 60 as further referenced in FIGS. 15(*a*) and 15(*b*). When grounding bushing assembly 600 is installed on a given conduit terminus, concave inner ring surface 59 and convex outer ring surface 60 tend toward a planar configuration or achieve a more flattened state under various compressive and tensile forces inherent in the pivoting closure of grounding bushing assembly 600 around a given conduit terminus. It is thus contemplated that electrical communication between grounding bushing assembly 600 and conduit terminus 1000 may be enhanced or increased by the inclusion of compressive ring structure such as here specified.

Alternative Embodiment No. 7

Figure 17A:
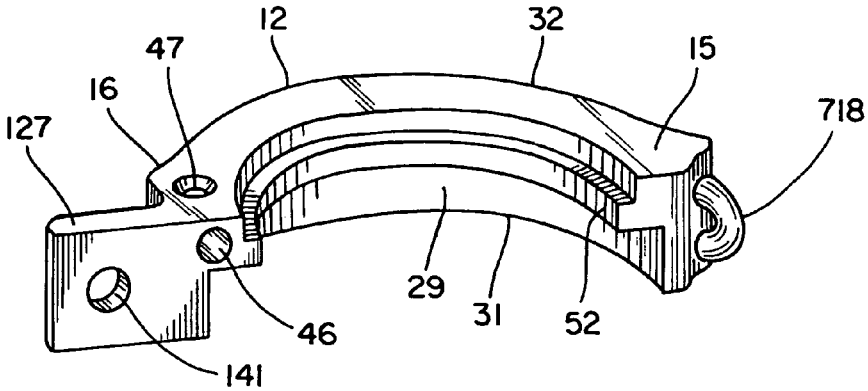
FIG. 17(*a*) is a perspective view of a second bushing section of the seventh alternative embodiment of the grounding bushing assembly as viewed from a conductor outlet end.
Figure 17B:
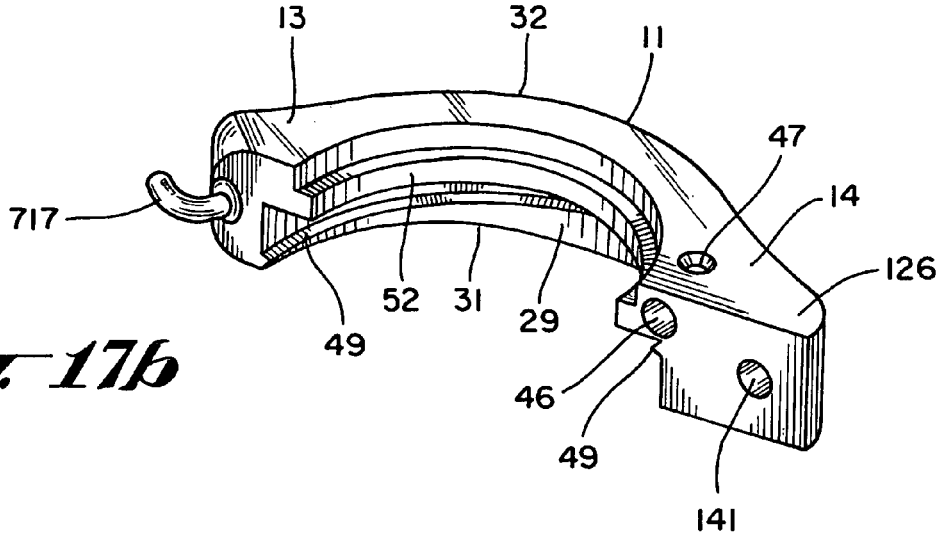

A seventh alternative embodiment of the present invention concerns a grounding bushing assembly 700 as has been generally illustrated and referenced in FIGS. 17(*a*) and 17(*b*), inclusive. FIG. 17(*a*) illustrates second bushing section 12 with its alternative structural contribution to the pivot or hinge means and FIG. 17(*b*) illustrates first bushing section 11 with its alternative structural contribution to the pivot or hinge means. Grounding bushing assembly 700 is substantially identical to grounding bushing assembly 100 save for certain features as identified in the hinge means. In this regard, it will be seen that the hinge means of grounding bushing assembly 700 preferably comprises first section triaxial pivot structure 717 as illustrated and referenced in FIG. 17(*b*) and second section triaxial pivot structure 718 as illustrated and referenced in FIG. 17(*a*). It will be seen from an inspection of the noted drawing figures that first section triaxial pivot structure 717 may be defined by hook-like means and that second section triaxial pivot structure 718 may be defined by loop-like means. The hook-like means is thus insertable in the loop-like means and pivotable about two pivot axes. Additionally, the hook-like means may be easily removed from the loop-like means and made to rotate about a third axis, thus providing the hinge means with the potential for triaxial movement.

It is further contemplated, however, that first section triaxial pivot structure 717 and/or second section triaxial pivot structure may comprise rotatable means for allowing triaxial movement without the need to remove second section triaxial pivot structure 718 from first section triaxial pivot structure 717. The contemplated rotatable means would allow rotation about a third axis thus extending through the two pivot axes. Triaxial movement will allow the installer to move either first bushing section 11 or second bushing section 12 to more easily install grounding bushing assembly 700. In this regard, it is contemplated that a triaxially movable pivot means such as here specified will provide the installer with enhanced structural flexibility to install grounding bushing assembly 700 if the need arises.

Alternative Embodiment No. 8

An eighth alternative embodiment of the present invention concerns a grounding bushing assembly, the second bushing section 12 of which, is illustrated in FIGS. 18, 19, and 21. The eighth alternative embodiment of the grounding bushing assembly is substantially identical to grounding bushing assembly 100 save for the addition of certain features to inner annular surface 29. In this regard, inner annular surface 29 of the eighth alternative embodiment of the grounding bushing assembly preferably comprises a spring member 61 as illustrated and referenced in FIGS. 18, 19, and 20; and spring member-receiving means. The spring member-receiving means may be defined by comprising a spring member-receiving pit, groove or notch 62 hollowed out of inner annular surface 29 as generally illustrated in FIGS. 18 and 21. Spring member 61 is removably insertable into notch 62 and when the eighth alternative embodiment of the grounding bushing assembly is placed on a conduit terminus, compressive forces compress (and thus displace) the spring member from a relaxed state effectively retaining the spring member intermediate the conduit terminus and the grounding bushing. It is contemplated that by including spring member 61 into the design of the eighth alternative embodiment of the grounding bushing assembly, the installer may enhance or increase electrical communication between the grounding bushing assembly and the conduit terminus.

Alternative Embodiment No. 9

Figure 22:
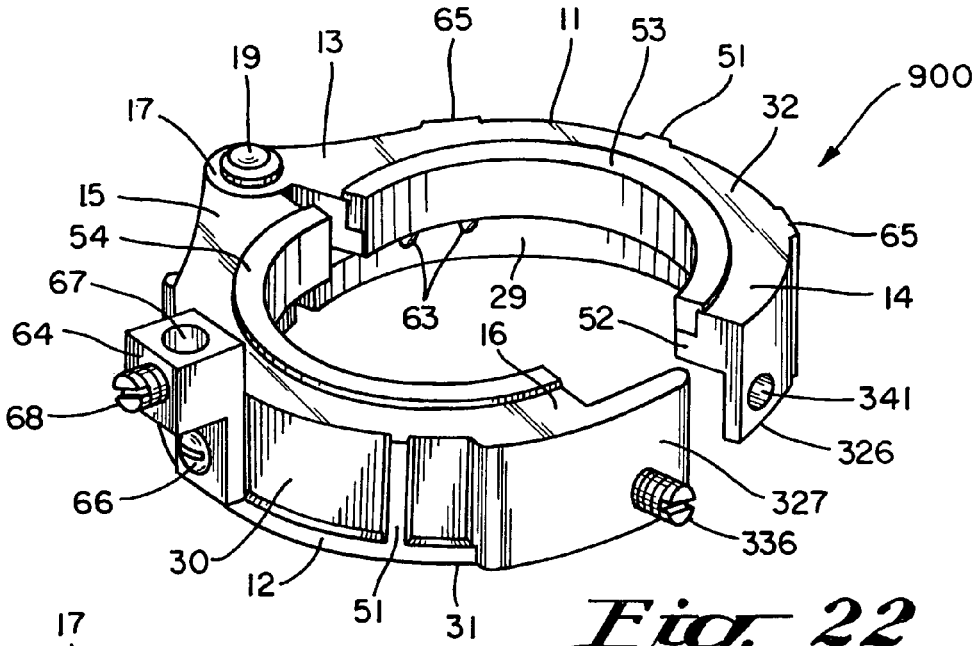
FIG. 22 is a perspective view of a ninth alternative embodiment of the grounding bushing assembly in a pivoted open state as viewed from a conductor outlet end.
Figure 23:
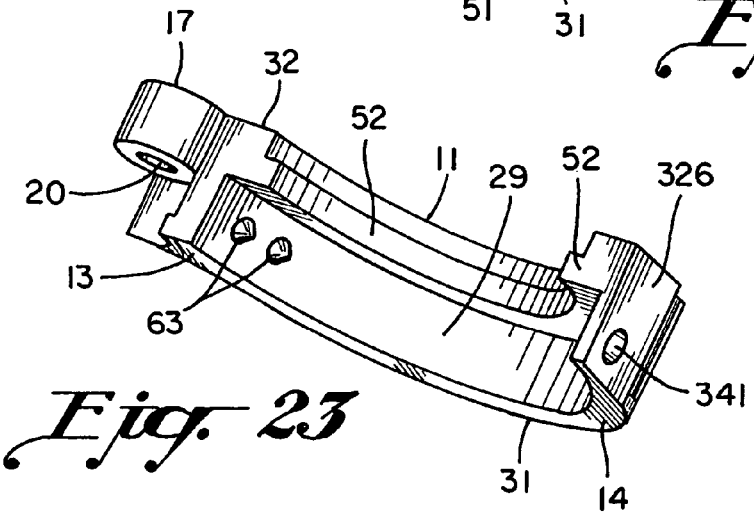
FIG. 23 is a perspective view of a first bushing section of the ninth alternative embodiment of the grounding bushing assembly showing two conductive contact spikes as viewed from a conductor inlet end.
Figure 24:
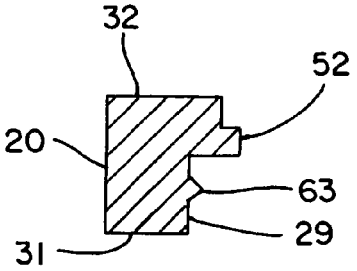
FIG. 24 is cross-sectional view of the first bushing section of FIG. 23 through a conductive contact spike.
Figure 25:
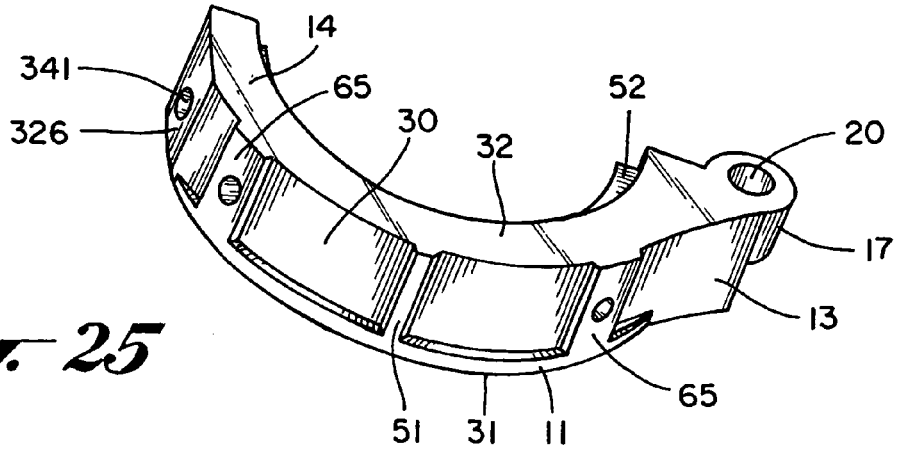
FIG. 25 is a perspective view of the first bushing section of the ninth alternative embodiment of the grounding bushing assembly showing an outer annular surface as viewed the conductor outlet end.

A ninth alternative embodiment of the present invention concerns a grounding bushing assembly 900 as has been generally illustrated and referenced in FIGS 22. Grounding bushing assembly 900 is substantially identical to grounding bushing assembly 300 save for certain features of inner annular surface 29. In this regard, grounding bushing assembly 900 preferably comprises at least one conductive contact peak or spike 63, two of which have been illustrated and referenced in FIGS. 22 and 23. A cross sectional view through a single conductive contact peak or conductive contact spike 63 is shown in FIG. 24. It will be noted from an inspection of the noted drawing figures that conductive contact spikes 63 are essentially conical or pyramidal protuberances on inner annular surface 29. Preferably, these protuberances are constructed from electrically conductive materials. Conductive contact peaks or spikes 63 function to contact conduit terminus 1000 when grounding bushing assembly 900 is installed so as to enhance or increase electrical communication between grounding bushing assembly 900 and the given conduit terminus to which it is attached.

It will be seen that the present invention provides a dual-sectioned grounding bushing assembly, which assembly allows installers thereof to install the assembly after electrical connections are finalized. To achieve this, the grounding bushing comprises first and second bushing sections pivotable about a pivot point, and removably fastenable at a latch point. An otherwise annular grounding bushing is thus openable to allow matter (or, more particularly, finally connected electrical conductors) to pass radially from regions exterior to the outer annular surface to regions radially inward from the inner annular surface. Further, the present invention provides a plurality of select latch means, a plurality of select hinge means, a plurality of select inner annular conductive contact means, a plurality of select conductor outlet bushing means, a and a plurality of select ground conductor attachment means.

While the above description contains much specificity, this specificity should not be construed as limitations on the scope of the invention, but rather as an exemplification of the invention. For example, as is described hereinabove, it is contemplated that the present invention provides a plurality of select latch means, the select latch means being chosen from the group consisting of consisting of axially-orthogonal latch means and select axially-parallel latch means. The select axially-parallel latch means are in turn selected from the group consisting of ball-plunger knuckle latch means and latch-pin knuckle latch means. As earlier specified, the select latch means function to removably fastening the first section latch end to the second section latch end such that the first and second section arc lengths cooperatively form an annular, dual-sectioned grounding bushing, the grounding bushing comprising an inner annular surface, an outer annular surface, a conductor inlet end, a conductor outlet end, and a bushing axis. The select latch means may be defined in more detail by the following descriptions.

The axially-orthogonal latch means may be defined by first section latch structure, second section latch structure, and a latch pin. The first section latch structure is integrally formed with the first bushing section adjacent the first section latch end and the second section latch structure is integrally formed with the second bushing section adjacent the second section latch end. The first and second latch structures each comprise latch pin-receiving structure, which latch pin-receiving structure has a latch pin axis. The latch pin is removably insertable into the latch pin-receiving structure for removably fastening the first section latch end to the second section latch end. The latch pin axis is thus substantially orthogonal (whether spaced or intersecting) to the bushing axis.

The ball-plunger knuckle latch means may be defined by first section latch knuckle structure, second section knuckle structure, an inlet end ball plunger and an outlet end ball plunger. The first section latch knuckle structure comprises an inlet end knuckle and an outlet end knuckle. The inlet end knuckle is in axially spaced relation to the outlet end knuckle. The inlet end knuckle and the outlet end knuckle thus define a knuckle-receiving gap. The inlet end and outlet end ball plungers each comprise a ball end, a head end, and spring means for ball end displacement. The inlet end and outlet end ball plungers are insertable in the latch pin-receiving structure such that the ball ends extend into the knuckle-receiving gap. The second section latch knuckle structure comprises an inlet end surface and an outlet end surface. The inlet end and the outlet end surfaces each comprise axially-aligned ball-receiving dimples. The second section latch knuckle structure is receivable in the knuckle-receiving gap. The spring means allow the ball ends to be oppositely displaced and seatable in the ball-receiving dimples for removably fastening the first section latch end to the second section latch end. Notably, the latch pin axis is substantially parallel to the bushing axis.

The latch-pin knuckle latch means may be defined by first section latch knuckle structure, second section latch knuckle structure, and a latch pin. The first section latch knuckle structure is integrally formed with the first bushing section adjacent the first section latch end and the second section latch knuckle structure is integrally formed with the second bushing section adjacent the second section latch end. The first and second latch knuckle structures each comprise latch pin-receiving structure, which structure has a latch pin axis. The latch pin is insertable into the latch pin-receiving structure for removably fastening the first section latch end to the second section latch end. The latch pin axis is substantially parallel to the bushing axis.

It is thus contemplated that the latch pin axis may have a select latch axis orientation, the select latch axis orientation being selected from the group consisting of a hinge-post (or pin) parallel orientation, a hinge-post (or pin) orthogonal orientation, a bushing-axis parallel orientation, and a bushing-axis orthogonal orientation. The hinge post parallel orientation is defined by the latch pin axis being substantially parallel to the hinge post (or pin) axis and the hinge post orthogonal orientation is defined by the latch pin axis being substantially orthogonal to the hinge post (or pin) axis. Similarly the bushing-axis parallel orientation may be defined by the latch pin axis being substantially parallel to the bushing axis and the bushing-axis orthogonal orientation may be defined by the latch pin axis being substantially orthogonal to the bushing axis.

Further, it is contemplated that the present invention provides a plurality of select pivot means or hinge means. The select pivot means or select hinge means may be selected from the group consisting of insertable-pin hinge means, fixed-post hinge means, and triaxial pivot means. The select pivot means function to movably connect the first bushing section to the second bushing section and may be described in more detail by the following language.

The insertable-pin hinge means may be defined by first section hinge knuckle structure, second section hinge knuckle structure, and a hinge pin. The first section hinge knuckle structure is integrally formed with the first bushing section adjacent the first section hinge end and the second section hinge knuckle structure is integrally formed with the second bushing section adjacent the second section hinge end. The first and second hinge knuckle structures each comprise hinge pin-receiving structure, which structure has a hinge pin axis. The hinge pin is insertable into the hinge pin-receiving structure for pivotally connecting the first bushing section to the second bushing section.

The fixed-post hinge means may be defined by first section hinge knuckle structure, second section hinge knuckle structure, and a fixed hinge post. The first section hinge knuckle structure is integrally formed with the first bushing section adjacent the first section hinge end. The second section hinge knuckle structure is integrally formed with the second bushing section adjacent the second section hinge end. The hinge post is integrally formed with the second hinge knuckle structure and has a hinge post axis. The first hinge knuckle structure comprises hinge post-receiving structure, which is cooperatively associated with the hinge post for pivotally connecting the first bushing section to the second bushing section.

The triaxial pivot means may be defined by first section pivot structure and second section pivot structure. The first section pivot structure is integrally formed with the first bushing section adjacent the first section pivot end and the second section pivot structure is integrally formed with the second bushing section adjacent the second section pivot end. The first and second section pivot structures are cooperatively associated with one another for movably connecting the first bushing section to the second bushing section. The triaxial pivot means thus allow triaxial movement between the first bushing section and the second bushing section.

It is further contemplated that the present invention provides select ground conductor attachment means. In this regard, it is contemplated that in addition to the ground conductor attachment means as earlier described and defined, it is contemplated that the new combination of the dual-sectioned grounding bushing as detailed herein with traditional ground conductor attachment means is novel and unobvious. In this regard, it is contemplated that ground conductor attachment means may also be defined by ground conductor-receiving structure 64, attachable to outer annular surface 30 substantially as illustrated and referenced in FIG. 22. In this regard, the ground conductor attachment means may be further defined by comprising ground conductor attachment bosses 65 as illustrated and referenced in FIGS. 22 and 25. Fastening means 66 generally fasten ground conductor-receiving structure to a given grounding bushing assembly as referenced in FIG. 22. Ground conductor-receiving structure generally comprises a ground conductor-accepting tunnel 67 with a set screw-receiving tunnel substantially orthogonal thereto. As further illustrated and referenced in FIG. 22, a set screw 68 may thus removably attach a ground conductor to the grounding bushing.

The present invention further contemplates that the grounding bushing may comprise select bushing means, the select bushing means being cooperatively associated with the grounding bushing for protecting electrical conductor passing thereover. The select bushing means are thus spatially located intermediate the conductor inlet end and the conductor outlet end adjacent the inner annular surface. The select bushing means are selected from the group consisting of an annular flange, a dual-sectioned bushing member, and an annular beveled surface, substantially as earlier described.

The present invention further contemplates that the inner annular surface may comprise select conductive contact means or structure. The select conductive contact structure is designed to enhance or increase electrical communication with the conduit terminus. The select conductive contact structure may be selected from the group consisting of a conductive contact ridge, at least one conductive contact spike, a conductive contact spring member, and select compression ring structure. The select compression ring structure is selected from the group consisting of a gapped compression ring and a dual-sectioned compression ring, substantially as earlier described.

Although a substantially linear spring member 61 has been illustrated as the preferred spring member of the eighth grounding bushing assembly, it is further contemplated that a coil-type spring member will suffice to provide increased electrical communication between the grounding bushing and the given conduit terminus. Thus, a coil type spring member is believed to fall within the spirit of the present invention although a coil-type spring member has not been specified in detail by the foregoing.

Accordingly, although the invention has been described by reference to a preferred embodiment as well as a series of alternative embodiments, it is not intended that the novel assembly be limited thereby, but that modifications thereof are intended to be included as falling within the broad scope and spirit of the foregoing disclosure, the following claims and the appended drawings.

We claim:

1. A dual-sectioned, grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

hinge means, the hinge means comprising first section hinge knuckle structure, second section hinge knuckle structure and a hinge pin, the first section hinge knuckle structure integrally formed with the first bushing section adjacent the first section hinge end, the second section hinge knuckle structure integrally formed with the second bushing section adjacent the second section hinge end, the first and second hinge knuckle structures each comprising hinge pin-receiving structure, the hinge pin-receiving structure having a hinge pin axis, the hinge pin insertable into the hinge pin-receiving structures for pivotally connecting the first bushing section to the second bushing section, the first bushing section and the second bushing section being pivotable about a pivot axis when pivotally connected, the pivot axis being collinear with the hinge pin axis;

latch means, the latch means comprising first section latch knuckle structure, second section latch knuckle structure and latch pin means, the first section latch knuckle structure integrally formed with the first bushing section adjacent the first section latch end, the second section latch knuckle structure integrally formed with the second bushing section adjacent the second section latch end, the first and second latch knuckle structures each comprising latch pin-receiving structure, the latch pin-receiving structure having a latch pin axis, the latch pin axis being substantially parallel to the hinge pin axis, the latch pin means insertable into the latch pin-receiving structure for removably fastening the first section latch end to the second section latch end, the first and second section arc lengths thus cooperatively forming an annular, dual-sectioned, grounding bushing, the grounding bushing comprising an inner annular surface, an outer annular surface, a conductor inlet end, a conductor outlet end, and a bushing axis, the bushing axis being substantially parallel to the latch pin axis and the hinge pin axis, the conductor inlet end for receiving at least one electrical conductor, the electrical conductor exiting a conduit terminus, the conductor inlet end for removable attachment to the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

2. The grounding bushing assembly of claim 1 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

3. The grounding bushing assembly of claim 2 wherein the superior conductor-receiving structure comprises ground conductor set means for fixedly setting a ground conductor in contact with the grounding bushing assembly for enabling more proper grounding.

4. The grounding bushing assembly of claim 3 wherein the ground conductor set means is defined by set screw-receiving structure and a set screw cooperatively associated with the set screw-receiving structure.

5. The grounding bushing assembly of claim 4 wherein the set screw-receiving structure is formed in the superior C portion.

6. The grounding bushing assembly of claim 5 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

7. A dual-sectioned, grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

hinge means, the hinge means comprising first section hinge knuckle structure, second section hinge knuckle structure and a hinge pin, the first section hinge knuckle structure integrally formed with the first bushing section adjacent the first section hinge end, the second section hinge knuckle structure integrally formed with the second bushing section adjacent the second section hinge end, the first and second hinge knuckle structures each comprising hinge pin-receiving structure, the hinge pin-receiving structure having a hinge pin axis, the hinge pin insertable into the hinge pin-receiving structure for pivotally connecting the first bushing section to the second bushing section, the first bushing section and the second bushing section being pivotable about a pivot axis when pivotally connected, the pivot axis being collinear with the hinge pin axis;

latch means, the latch means comprising first section latch structure, second section latch structure and a latch pin, the first section latch structure integrally formed with the first bushing section adjacent the first section latch end, the second section latch structure integrally formed with the second bushing section adjacent the second section latch end, the first and second latch structures each comprising latch pin-receiving structure, the latch pin-receiving structure having a latch pin axis, the latch pin removably insertable into the latch pin-receiving structure for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis, the bushing axis being substantially parallel to the hinge pin axis, the inner annular surface comprising a circumferential seat flange, the seat flange being intermediate the conductor inlet end and the conductor outlet end;

a dual-sectioned, insulative bushing member, the insulative bushing member comprising a first insulative section and a second insulative section, the first and second insulative sections each comprising a first insulative end, a second insulative end, and an insulative arc length intermediate the first insulative end and the second insulative end, the first and second insulative sections thus cooperatively forming an annular, dual-sectioned bushing member, the bushing member being sized and shaped to snugly seat upon the seat flange, the conductor inlet end for receiving at least one electrical conductor, the electrical conductor exiting a conduit terminus, the conductor inlet end for removable attachment to the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

8. The grounding bushing assembly of claim 7 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

9. The grounding bushing assembly of claim 8 wherein the superior conductor-receiving structure comprises ground conductor set means for fixedly setting a ground conductor in contact with the grounding bushing assembly for enabling more proper grounding.

10. The grounding bushing assembly of claim 9 wherein the ground conductor set means is defined by set screw-receiving structure and a set screw cooperatively associated with the set screw-receiving structure.

11. The grounding bushing assembly of claim 10 wherein the set screw-receiving structure is formed in the superior C portion.

12. The grounding bushing assembly of claim 11 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

13. A dual-sectioned, grounding bushing assembly, the grounding bushing assembly enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

hinge means, the hinge means comprising first section hinge knuckle structure, second section hinge knuckle structure, and a fixed hinge post, the first section hinge knuckle structure integrally formed with the first bushing section adjacent the first section hinge end, the second section hinge knuckle structure integrally formed with the second bushing section adjacent the second section hinge end, the hinge post being integrally formed with the second section hinge knuckle structure, the hinge post having a hinge post axis, the first section hinge knuckle structure comprising hinge post-receiving structure, the hinge post-receiving structure being cooperatively associated with the hinge post for pivotally connecting the first bushing section to the second bushing section, the first bushing section and the second bushing section being pivotable about a pivot axis when pivotally connected, the pivot axis being collinear with the hinge post axis;

latch means, the latch means comprising first section latch structure, second section latch structure and a latch pin, the first section latch structure integrally formed with the first bushing section adjacent the first section latch end, the second section latch structure integrally formed with the second bushing section adjacent the second section latch end, the first and second latch structures each comprising latch pin-receiving structure, the latch pin-receiving structure having a latch pin axis, the latch pin removably insertable into the latch pin-receiving structure for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis, the bushing axis being substantially parallel to the hinge post axis, the conductor inlet end for receiving at least one electrical conductor, the electrical conductor exiting a conduit terminus, the conductor inlet end for removable attachment to the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

14. The grounding bushing assembly of claim 13 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

15. The grounding bushing assembly of claim 14 wherein the superior conductor-receiving structure comprises ground conductor set means for fixedly setting a ground conductor in contact with the grounding bushing assembly for enabling more proper grounding.

16. The grounding bushing assembly of claim 15 wherein the ground conductor set means is defined by set screw-receiving structure and a set screw cooperatively associated with the set screw-receiving structure.

17. The grounding bushing assembly of claim 16 wherein the set screw-receiving structure is formed in the superior C portion.

18. The grounding bushing assembly of claim 17 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

19. A dual-sectioned grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

hinge means, the hinge means comprising first section hinge knuckle structure, second section hinge knuckle structure and a hinge pin, the first section hinge knuckle structure integrally formed with the first bushing section adjacent the first section hinge end, the second section hinge knuckle structure integrally formed with the second bushing section adjacent the second section hinge end, the first and second hinge knuckle structures each comprising hinge pin-receiving structure, the hinge pin-receiving structure having a hinge pin axis, the hinge pin insertable into the hinge pin-receiving structures for pivotally connecting the first bushing section to the second bushing section, the first bushing section and the second bushing section being pivotable about a pivot axis when pivotally connected, the pivot axis being collinear with the hinge pin axis;

latch means, the latch means comprising first section latch structure, second section latch structure and at least one latch pin, the first section latch structure integrally formed with the first bushing section adjacent the first section latch end, the second section latch structure integrally formed with the second bushing section adjacent the second section latch end, the first and second latch structures each comprising latch pin-receiving structure, the latch pin-receiving structure having a latch pin axis, the latch pin removably insertable into the latch pin-receiving structure for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis, the bushing axis being substantially parallel to the hinge pin axis, the conductor inlet end for receiving at least one electrical conductor, the electrical conductor exiting a conduit terminus, the conductor inlet end for removable attachment to the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

20. The grounding bushing assembly of claim 19 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

21. The grounding bushing assembly of claim 20 wherein the superior conductor-receiving structure comprises ground conductor set means for fixedly setting a ground conductor in contact with the grounding bushing assembly for enabling more proper grounding.

22. The grounding bushing assembly of claim 21 wherein the ground conductor set means is defined by set screw-receiving structure and a set screw cooperatively associated with the set screw-receiving structure.

23. The grounding bushing assembly of claim 22 wherein the set screw-receiving structure is formed in the superior C portion.

24. The grounding bushing assembly of claim 23 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

25. A dual-sectioned grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

pivot means, the pivot means comprising first section pivot structure and second section pivot structure, the first section pivot structure integrally formed with the first bushing section adjacent the first section pivot end, the second section pivot structure integrally formed with the second bushing section adjacent the second section pivot end, the first and second pivot structures cooperatively associated with one another for movably connecting the first bushing section to the second bushing section, the first bushing section being triaxially movable with respect to the second bushing section when movably connected thereto;

latch means, the latch means comprising first section latch structure, second section latch structure and latch pin means, the first section latch structure integrally formed with the first bushing section adjacent the first section latch end, the second section latch structure integrally formed with the second bushing section adjacent the second section latch end, the first and second latch structures each comprising latch pin-receiving structure, the latch pin-receiving structure having a latch pin axis, the latch pin means removably insertable into the latch pin-receiving structure for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis, the conductor inlet end for receiving at least one electrical conductor, the electrical conductor exiting a conduit terminus, the conductor inlet end for removable attachment to the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

26. The grounding bushing assembly of claim 25 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

27. The grounding bushing assembly of claim 26 wherein the superior conductor-receiving structure comprises ground conductor set means for fixedly setting a ground conductor in contact with the grounding bushing assembly for enabling more proper grounding.

28. The grounding bushing assembly of claim 27 wherein the ground conductor set means is defined by set screw-receiving structure and a set screw cooperatively associated with the set screw-receiving structure.

29. The grounding bushing assembly of claim 28 wherein the set screw-receiving structure is formed in the superior C portion.

30. The grounding bushing assembly of claim 29 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

31. A dual-sectioned grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section hinge end, a first section latch end, and a first section arc length intermediate the first section hinge end and the first section latch end, the second bushing section comprising a second section hinge end, a second section latch end, and a second section arc length intermediate the second section hinge end and the second section latch end;

hinge means, the hinge means comprising first section hinge knuckle structure, second section hinge knuckle structure and a hinge pin, the first section hinge knuckle structure integrally formed with the first bushing section adjacent the first section hinge end, the second section hinge knuckle structure integrally formed with the second bushing section adjacent the second section hinge end, the first and second hinge knuckle structures each comprising hinge pin-receiving structure, the hinge pin-receiving structure having a hinge pin axis, the hinge pin insertable into the hinge pin-receiving structures for pivotally connecting the first bushing section to the second bushing section, the first bushing section and the second bushing section being pivotable about a pivot axis when pivotally connected, the pivot axis being collinear with the hinge pin axis;

latch means, the latch means comprising first section latch structure, second section latch structure and a latch pin, the first section latch structure integrally formed with the first bushing section adjacent the first section latch end, the second section latch structure integrally formed with the second bushing section adjacent the second section latch end, the first and second latch structures each comprising latch pin-receiving structure, the latch pin-receiving structure having a latch pin axis, the latch pin removably insertable into the latch pin-receiving structures for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis, the inner annular surface comprising at least one spring member-receiving structure, the spring member-receiving structure being intermediate the conductor inlet end and the conductor outlet end;

at least one spring member, the conductor inlet end for receiving at least one electrical conductor, the electrical conductor exiting a conduit terminus, the conductor inlet end for removable attachment to the conduit terminus, the spring member being insertable into the spring member-receiving structure for increasing electrical communication with the conduit terminus, the electrical conductor for finalized electrical connectivity to structure adjacent the conduit terminus, the grounding bushing assembly thus enabling an installer to install the grounding bushing assembly either before or after electrical connections are finalized; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

32. The grounding bushing assembly of claim 31 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

33. The grounding bushing assembly of claim 32 wherein the superior conductor-receiving structure comprises ground conductor set means for fixedly setting a ground conductor in contact with the grounding bushing assembly for enabling more proper grounding.

34. The grounding bushing assembly of claim 33 wherein the ground conductor set means is defined by set screw-receiving structure and a set screw cooperatively associated with the set screw-receiving structure.

35. The grounding bushing assembly of claim 34 wherein the set screw-receiving structure is formed in the superior C portion.

36. The grounding bushing assembly of claim 35 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

37. A grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section pivot end, a first section latch end, and a first section arc length intermediate the first section hinge end and the first section latch end, the second bushing section comprising a second section pivot end, a second section latch end, and a second section arc length intermediate the second section pivot end and the second section latch end;

select pivot means, the select pivot means being selected from the group consisting of insertable-pin hinge means, fixed-post hinge means, and triaxial pivot means, the select pivot means for movably connecting the first bushing section to the second bushing section;

select latch means, the select latch means being selected from the group consisting of axially-orthogonal latch means and select axially-parallel latch means, the select axially-parallel latch means being selected from the group consisting of ball-plunger knuckle latch means and latch-pin knuckle latch means, the select latch means for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

38. The grounding bushing assembly of claim 37 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

39. The grounding bushing assembly of claim 38 wherein the superior conductor-receiving structure comprises ground conductor set means for fixedly setting a ground conductor in contact with the grounding bushing assembly for enabling more proper grounding.

40. The grounding bushing assembly of claim 39 wherein the ground conductor set means is defined by set screw-receiving structure and a set screw cooperatively associated with the set screw-receiving structure.

41. The grounding bushing assembly of claim 40 wherein the set screw-receiving structure is formed in the superior C portion.

42. The grounding bushing assembly of claim 41 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

43. A grounding bushing assembly, the grounding bushing assembly for enabling an installer to install the grounding bushing assembly either before or after electrical connections are finalized, the grounding bushing assembly comprising:

a first bushing section and a second bushing section, the first bushing section comprising a first section pivot end, a first section latch end, and a first section arc length intermediate the first section hinge end and the first section latch end, the second bushing section comprising a second section pivot end, a second section latch end, and a second section arc length intermediate the second section pivot end and the second section latch end;

pivot means, the pivot means for movably connecting the first bushing section to the second bushing section;

latch means, the latch means for removably fastening the first section latch end to the second section latch end, the first and second section arc lengths thus cooperatively forming an annular, dual-sectioned grounding bushing, the grounding bushing comprising an inner annular surface, an outer annular surface, a conductor inlet end, a conductor outlet end, and a bushing axis; and a substantially C-shaped ground conductor-receiving structure, the conductor-receiving structure for removably attaching a ground conductor to the grounding bushing, the conductor-receiving structure comprising a spine, a superior C portion, an inferior C portion, the spine being fixedly attached to the outer annular surface, the spine, superior C portion, and inferior C portion together defining a ground conductor-receiving groove, the conductor-receiving groove being sized and shaped to receive a ground conductor.

44. The grounding bushing assembly of claim 43 wherein the conductor-receiving structure comprises a substantially planar first face, a substantially planar second face, and a structural thickness intermediate the first face and the second face, the conductor-receiving groove having a groove axis, the groove axis being substantially orthogonal to the first face and the second face.

45. The grounding bushing assembly of claim 44 wherein the superior conductor-receiving structure comprises ground conductor set means for fixedly setting a ground conductor in contact with the grounding bushing assembly for enabling more proper grounding.

46. The grounding bushing assembly of claim 45 wherein the ground conductor set means is defined by set screw-receiving structure and a set screw cooperatively associated with the set screw-receiving structure.

47. The grounding bushing assembly of claim 46 wherein the set screw-receiving structure is formed in the superior C portion.

48. The grounding bushing assembly of claim 47 wherein the superior C portion extends radially outward from the grounding bushing assembly and the inferior C portion extends radially outward and towards the superior C portion, the conductor-receiving groove thus comprising a conductor seat, the conductor seat being structurally situated intermediate the conductor inlet end and the conductor outlet end for decreasing the charge migratory distance from the grounding bushing assembly to the ground conductor.

* * * * *